US010747137B2

(12) United States Patent
Ishidate et al.

(10) Patent No.: US 10,747,137 B2
(45) Date of Patent: Aug. 18, 2020

(54) IMAGE FORMING APPARATUS INCLUDING OPTICAL PRINT HEAD

(71) Applicant: CANON KABUSHIKI KAISHA, Tokyo (JP)

(72) Inventors: Takehiro Ishidate, Tokyo (JP); Daisuke Aruga, Abiko (JP); Toshiki Momoka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/460,248

(22) Filed: Jul. 2, 2019

(65) Prior Publication Data

US 2020/0019083 A1 Jan. 16, 2020

(30) Foreign Application Priority Data

Jul. 12, 2018 (JP) ..... 2018-132661

(51) Int. Cl.
*G03G 15/04* (2006.01)
*G03G 21/16* (2006.01)
*G03G 15/043* (2006.01)

(52) U.S. Cl.
CPC ..... *G03G 15/04036* (2013.01); *G03G 15/043* (2013.01); *G03G 21/1652* (2013.01)

(58) Field of Classification Search
CPC ..... G03G 15/04036; G03G 21/1652; G03G 15/043
See application file for complete search history.

(56) References Cited

U.S. PATENT DOCUMENTS 8,879,950 B2 * 11/2014 Sato ..... G03G 21/1633 399/110
8,897,950 B2 11/2014 Roberts
9,304,477 B2 * 4/2016 Sone ..... G03G 15/80
2018/0364608 A1 * 12/2018 Momoka ..... G03G 15/087
2018/0364609 A1 * 12/2018 Ishidate ..... G03G 15/04036
2018/0364610 A1 * 12/2018 Okada ..... G03G 15/04036
2018/0364611 A1 * 12/2018 Gokyu ..... G03G 21/1647
2018/0364612 A1 * 12/2018 Ishidate ..... G03G 15/04036
2018/0364613 A1 * 12/2018 Momoka ..... G03G 21/1647
(Continued)

FOREIGN PATENT DOCUMENTS

JP 2013-134370 A 7/2013
JP 2015-205497 A 11/2015
JP 2018-157358 A 10/2018

*Primary Examiner* — Huan H Tran
(74) *Attorney, Agent, or Firm* — Canon U.S.A., Inc. I.P. Division

(57) ABSTRACT

An image forming apparatus includes a print head to expose a drum to light, a first supporting unit supporting the print head and to move to mounting and extraction positions, a cable to supply a print head driving signal, an abutting portion, and a second supporting unit having a holding unit to hold the cable and to support the first supporting member. When the print head moves to the mounting position from the extraction position in a state where the cable is connected to the print head, the abutting portion abuts on the cable in one area between a holding unit held portion and a print head connected portion and moves the one area in a direction in which the first supporting unit moves to the mounting position to form in the one area a curved area that is warped and curved toward the mounting position from the extraction position.

15 Claims, 15 Drawing Sheets

(56) References Cited

U.S. PATENT DOCUMENTS

2018/0364614 A1* 12/2018 Aruga ..... G03G 15/04054
2018/0364636 A1* 12/2018 Imai ..... G03G 15/04036
2019/0346809 A1* 11/2019 Iwai ..... G03G 21/1666

* cited by examiner

IMAGE FORMING APPARATUS INCLUDING OPTICAL PRINT HEAD

BACKGROUND

Field

The present disclosure relates to an image forming apparatus including an attachable/detachable optical print head that can be inserted to or removed from an apparatus main body.

Description of the Related Art

Of the image forming apparatuses such as printers and copying machines, there is an image forming apparatus including an optical print head having a plurality of light emitting elements for exposing a photosensitive drum to light. An optical print head using a light emitting element such as a light emitting diode (LED) or an organic electro luminescence (EL) is known, in which the light emitting elements are arrayed in one row or in two rows in a staggered arrangement in a rotation axis line direction of a photosensitive drum. The optical print head further includes a plurality of lenses for concentrating light emitted from the plurality of light emitting elements to the photosensitive drum. At a position between the plurality of light emitting elements and the photosensitive drum, the lenses are arranged along an array direction of the light emitting elements, facing a surface of the photosensitive drum.

The light emitting elements arranged on the optical print head emit light according to a driving signal from a control unit provided on an image forming apparatus. The driving signal from the control unit is transmitted to the optical print head through a cable. A technique described in Japanese Patent Application Laid-Open No. 2015-205497, uses a flexible flat cable (FFC) for supplying power from the control unit to an exposure unit having a light emitting element such as an LED.

Further, Japanese Patent Application Laid-Open No. 2015-205497 discusses a method for attaching and detaching a supporting bar having an exposure unit to/from an image forming apparatus.

The exposure unit described in Japanese Patent Application Laid-Open No. 2015-205497 is supported by a supporting bar formed of a material such as a sheet metal. When the supporting bar is mounted on the apparatus main body, the bar is supported by a supporting plate. The supporting plate is fixed to the apparatus main body. Further, a control substrate for controlling driving of the exposure unit is provided on the apparatus main body. The control substrate and the exposure unit are electrically connected to each other through a cable. A part of the cable is fixed to the supporting plate, so that a movement of the cable in a moving direction of the supporting bar is restricted.

In Japanese Patent Application Laid-Open No. 2015-205497, in a state where the supporting bar is stored in the apparatus main body, the cable warps in a U-shape between the supporting bar and the supporting plate from a rear side to a front side of the apparatus main body (or from the front side to the rear side thereof) to form a curved portion. When the exposure unit is replaced for maintenance, an engineer extracts the supporting bar placed at a mounting position to a front side by a warp amount in a warp area of the cable via an opening formed on a front side-plate. Then, the engineer detaches the cable from a connector provided on the exposure unit further on a rear side than the front side-plate.

Thereafter, the engineer extracts the supporting bar toward the front side, and carries out maintenance work for the exposure unit such as replacing the exposure unit with a new one.

SUMMARY

According to an aspect of the present disclosure, an image forming apparatus includes a photosensitive drum configured to rotate relative to an apparatus main body, a print head configured to expose the photosensitive drum to light according to a driving signal from a main body substrate fixed to the apparatus main body, a first supporting unit configured to support the print head and move to a mounting position at which the first supporting unit is mounted on the apparatus main body and an extraction position at which the first supporting unit is extracted from the apparatus main body together with the print head by sliding in a rotation axis line direction of the photosensitive drum, a cable for connecting the main body substrate and the print head and configured to supply, to the print head from the main body substrate, a driving signal for driving the print head, a second supporting unit having a holding portion for holding a part of the cable and regulating a movement of the part of the cable in a sliding direction, wherein the second supporting unit is fixed to the apparatus main body to support the first supporting member, and an abutting portion arranged on the first supporting unit further on a downstream side than a position at which the cable is connected to the print head, in a direction in which the first supporting unit moves from the extraction position to the mounting position, wherein, in a case where the print head moves to the mounting position from the extraction position in a state where the cable and the print head are connected to each other, the abutting portion abuts on the cable in one area between a portion held by the holding unit and a portion connected to the print head and moves the one area in a direction in which the first supporting unit moves to the mounting position from the extraction position to form in the one area a curved area that is warped and curved toward the mounting position from the extraction position.

Further features of the present disclosure will become apparent from the following description of exemplary embodiments with reference to the attached drawings.

BRIEF DESCRIPTION OF THE DRAWINGS

FIGS. 5A, 5B1, 5B2, 5C1, and 5C2 are diagrams illustrating a substrate and a lens array.

DESCRIPTION OF THE EMBODIMENTS

Hereinafter, an exemplary embodiment of the present disclosure will be illustratively described in detail with reference to the appended drawings. Sizes, materials, shapes and a relative arrangement of constituent elements described in the following present exemplary embodiments should be changed as appropriate according to a configuration or various conditions of the apparatus to which the present disclosure is applied. A scope of the present disclosure is not intended to be limited thereto unless such limitations are explicitly mentioned.

<General Configuration of Image Forming Apparatus>

Figure 1:
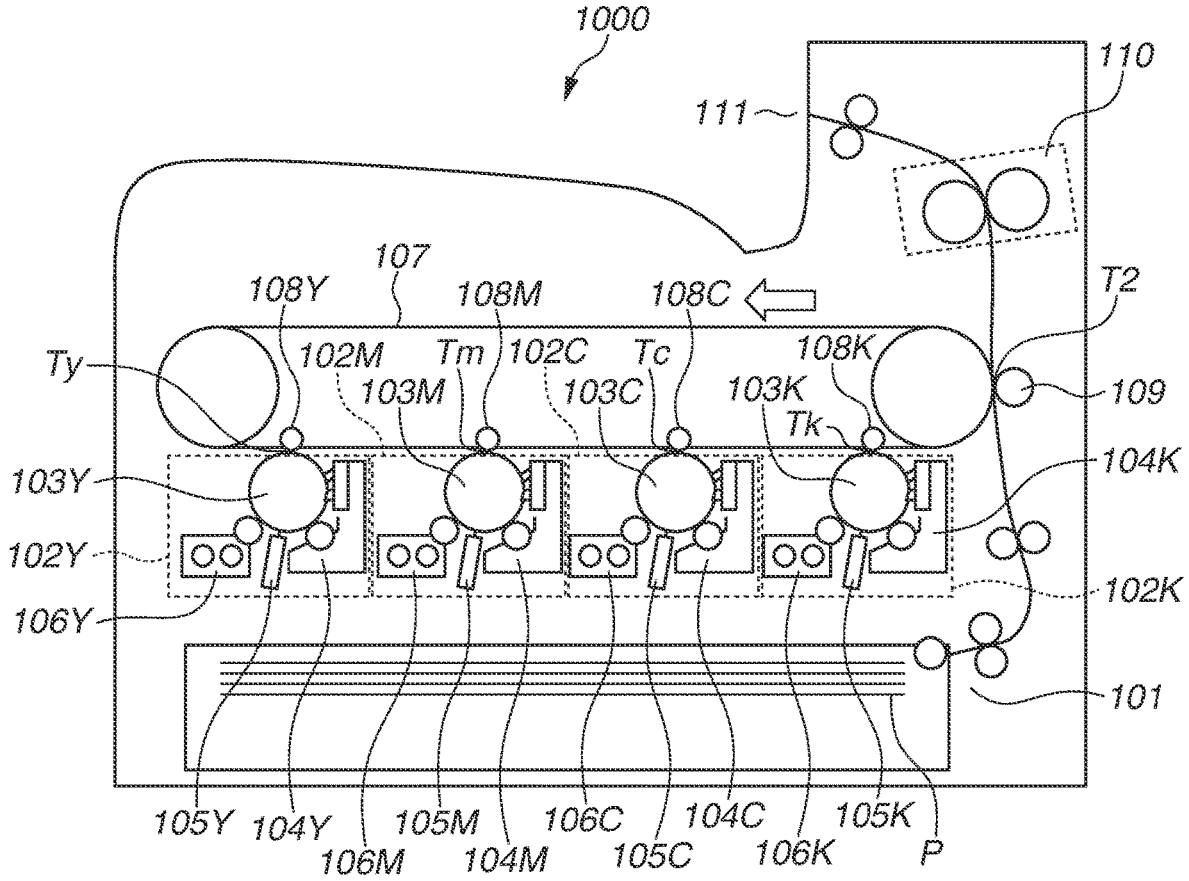
FIG. 1 is a diagram illustrating a configuration of an image forming apparatus.

Hereinafter, a first exemplary embodiment will be described. First, a schematic configuration of an image forming apparatus 1000 will be described with reference to FIG. 1. FIG. 1 is a schematic cross-sectional diagram of the image forming apparatus 1000. The image forming apparatus 1000 illustrated in FIG. 1 is a color printer (i.e., single function printer (SFP)) which does not include a reading device. However, the present exemplary embodiment is also applicable to a copying machine including a reading device.

The image forming apparatus 1000 in FIG. 1 includes four image forming units 102Y, 102M, 102C, and 102K for forming toner images of respective colors of yellow, magenta, cyan, and black. Hereinafter, the image forming units 102Y, 102M, 102C, and 102K may be collectively called as "image forming unit 102". The image forming units 102Y, 102M, 102C, and 102K respectively include photosensitive drums 103Y, 103M, 103C, and 103K. Hereinafter, the photosensitive drums 103Y, 103M, 103C, and 103K may be collectively called as "photosensitive drum 103". Charging units 104Y, 104M, 104C, and 104K for charging the photosensitive drums 103 (hereinafter, collectively called as "charging device 104"), optical print heads 105Y, 105M, 105C, and 105K for exposing the photosensitive drums 103 to light (hereinafter, collectively called as "optical print head 105 (an example of a print head)"), and development units 106Y, 106M, 106C, and 106K for developing electrostatic latent images formed on the photosensitive drums 103 with toner (hereinafter, collectively called as "development unit 106") are arranged in the peripheries of the photosensitive drums 103. Respective letters Y, M, C, and K added to reference numbers represent toner colors of yellow (Y), magenta (M), cyan (C), and black (K).

The image forming apparatus 1000 in FIG. 1 is an image forming apparatus employing a so-called lower face exposure system, which exposes the photosensitive drums 103 to light from underneath. Hereinafter, the present exemplary embodiment will be described on the assumption that the image forming apparatus 1000 employs the lower face exposure system. However, the present exemplary embodiment is also applicable to an image forming apparatus employing an upper face exposure type, which exposes the photosensitive drum 103 to light from above.

The image forming apparatus 1000 includes an intermediate transfer belt 107 onto which toner images formed on the photosensitive drums 103 are transferred and primary transfer rollers 108 (Y, M, C, and K) for sequentially transferring the toner images formed on the photosensitive drums 103 onto the intermediate transfer belt 107. The image forming apparatus 1000 further includes a secondary transfer roller 109 for transferring the toner image on the intermediate transfer belt 107 onto a recording sheet P conveyed from a sheet feeding unit 101 and a fixing unit 110 for fixing a secondarily-transferred image on the recording sheet P. The photosensitive drums 103Y, 103M, 103C, and 103K are in contact with the intermediate transfer belt 107 to respectively form primary transfer portions Ty, Tm, Tc, and Tk with the primary transfer rollers 108Y, 108M, 108C, and 108K.

<Image Forming Processing>

Next, image forming processing executed by the above-described image forming apparatus 100 will be briefly described. The charging unit 104Y charges a surface of the photosensitive drum 103Y. The optical print head 105Y exposes the surface of the photosensitive drum 103Y charged by the charging unit 104Y to light. With this processing, an electrostatic latent image is formed on the photosensitive drum 103Y. Then, the development unit 106Y develops the electrostatic latent image formed on the photosensitive drum 103Y with yellow toner. A yellow toner image developed on the surface of the photosensitive drum 103 is transferred onto the intermediate transfer belt 107 at the primary transfer portion Ty by the primary transfer roller 108Y. Through the similar image forming processing, toner images of respective colors of magenta, cyan, and black are also formed and transferred onto the intermediate transfer belt 107 in a superimposed state at respective primary transfer portions Tm, Tc, and Tk.

The toner images in respective colors transferred onto the intermediate transfer belt 107 are conveyed to a secondary transfer portion T2 by the intermediate transfer belt 107. Transfer bias for transferring the toner images onto the recording sheet P is applied to the secondary transfer roller 109 arranged at the secondary transfer portion T2. The toner images conveyed to the secondary transfer portion T2 are transferred onto a recording sheet P conveyed from the sheet feeding unit 101 with the transfer bias applied to the secondary transfer roller 109. The recording sheet P onto which the toner images are transferred is conveyed to the fixing unit 110. The fixing unit 110 fixes the toner images on the recording sheet P by applying heat and pressure thereto. The recording sheet P on which fixing processing is executed by the fixing unit 110 is discharged to a sheet discharge unit 111.

<Drum Unit and Development Unit>

Figure 2A:
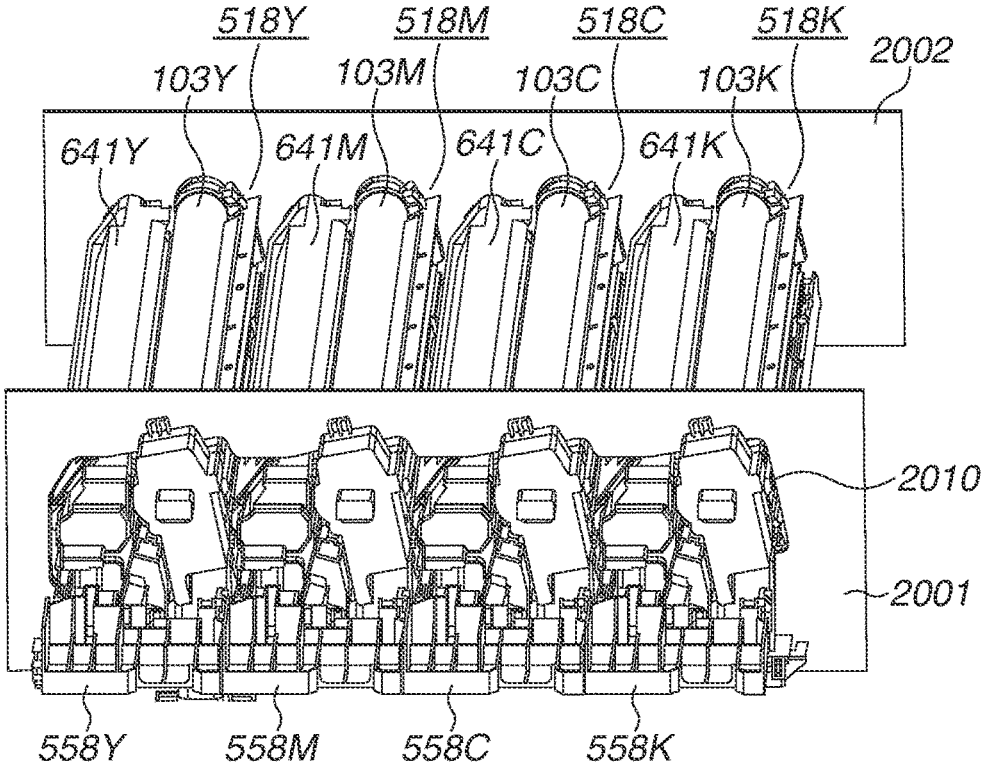
FIGS. 2A and 2B are diagrams illustrating peripheries of a drum unit and a development unit included in the image forming apparatus.

An interchangeable drum unit included in the image forming apparatus 1000 according to the present exemplary embodiment will be described illustratively. The photosensitive drum 103 and the charging unit 104 described above may integrally constitute a unit (i.e., a drum unit or a drum cartridge) together with a cleaning device (not illustrated). A configuration example thereof will be described with reference to FIGS. 2A and 2B. FIG. 2A is a perspective diagram illustrating a schematic configuration of peripheries of a drum unit 518 and a development unit 641 included in the image forming apparatus 1000. Further, FIG. 2B is a diagram illustrating a state where the drum unit 518 is inserted to the image forming apparatus 1000 from the outside of the apparatus main body.

Figure 2B:
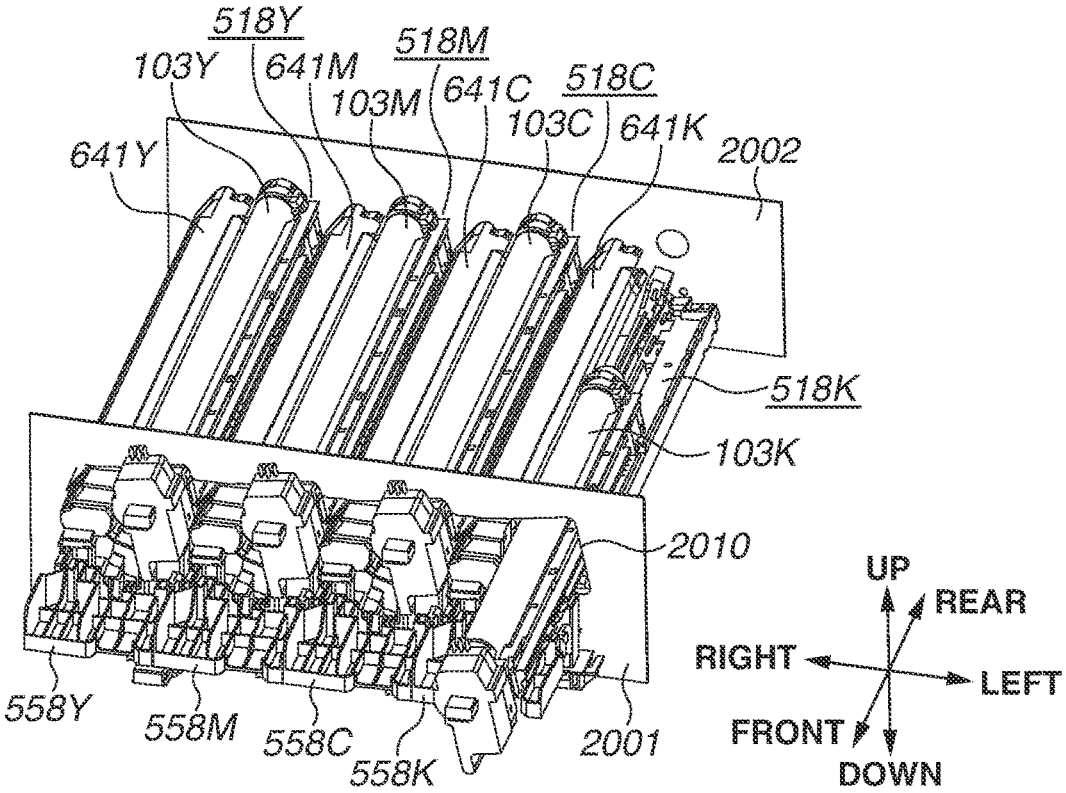

As illustrated in FIGS. 2A and 2B, interchangeable drum units 518Y, 518M, 518C, and 518K (hereinafter, collectively called as "drum unit 518") are mounted on the image forming apparatus 1000 of the present exemplary embodiment. The drum unit 518 is a cartridge replaced by an engineer such as a user or a maintenance worker. The drum unit 518 of the present exemplary embodiment rotatably supports the photosensitive drum 103. Specifically, the photosensitive drum 103 is rotatably supported by a frame body (housing) of the drum unit 518. For example, when the photosensitive drum 103 is worn down and its product life has come to the end because of cleaning performed by a cleaning device, an engineer who executes maintenance work takes out the drum unit 518 from the apparatus main body of the image forming apparatus 1000 via an opening 2010 formed on the below-described front-side plate 642 and replaces the photosensitive drum 103. The drum unit 518 may be configured of the photosensitive drum 103 without being provided with the charging unit 104 or the cleaning device.

Further, as illustrated in FIGS. 2A and 2B, units different from the drum units 518, i.e., development units 641Y, 641M, 641C, and 641K (hereinafter, collectively called as "development unit 641"), are mounted on the image forming apparatus 1000 of the present exemplary embodiment. The development unit 641 of the present exemplary embodiment is a cartridge in which the development unit 106 illustrated in FIG. 1 and a toner containing unit are configured integrally. The development unit 106 includes a development sleeve serving as a developer bearing member that bears developer. Gears that rotate a screw for agitating toner particles and carrier particles are arranged on the development unit 641. The engineer detaches the development unit 641 from the apparatus main body of the image forming apparatus 1000 and replaces the development unit 641 when these gears are degraded with age. The drum unit 518 and the development unit 641 may be formed as a process cartridge in which the above-described drum unit 518 and the development unit 641 are configured integrally.

As illustrated in FIG. 2A, the image forming apparatus 1000 includes a front-side plate 642 formed of a sheet metal and a rear-side plate 643 similarly formed of a sheet metal. The front-side plate 642 is a side wall that constitutes a part of the housing of the apparatus main body on the front side (front side) of the apparatus main body of the image forming apparatus 1000. The rear-side plate 643 is a side wall that constitutes a part of the housing of the apparatus main body on the rear side (rear side) of the apparatus main body of the image forming apparatus 1000. As illustrated in FIG. 2A, the front-side plate 642 and the rear-side plate 643 are arranged to face each other, and a sheet metal (not illustrated) serves as a beam for spanning therebetween. Each of the front-side plate 642, the rear-side plate 643, and the beam (not illustrated) constitutes a part of the housing of the image forming apparatus 1000.

An opening 2010 is formed on the front-side plate 642, so that the drum unit 518 or the development unit 641 can be inserted to or removed from the apparatus main body in the rotation axis line direction of the photosensitive drum on the front side of the image forming apparatus 1000. Each of the drum unit 518 and the development unit 641 is mounted on a predetermined position of the apparatus main body of the image forming apparatus 1000 via the opening 2010. Further, the image forming apparatus 1000 includes covers 558Y, 558M, 558C, and 558K (hereinafter, collectively called as "cover 558") for covering the front sides of both of the drum unit 518 and the development unit 641 mounted on the predetermined positions of the apparatus main body. One end of the cover 558 is fixed to the apparatus main body of the image forming apparatus 1000 with a hinge, so that the cover 558 is rotatable relative to the apparatus main body of the image forming apparatus 1000 with the hinge. The engineer opens the cover 558, takes out the drum unit 518 or the development unit 641 inside the main body, inserts a new drum unit 518 or a development unit 641 thereto, and closes the cover 558 to complete replacement work.

Herein, as illustrated in FIGS. 2A and 2B, a side of the front-side plate 642 is defined as a front side (i.e., front side), whereas a side of the rear-side plate 643 is defined as a rear side (i.e., rear side) of the apparatus main body of the image forming apparatus 1000. Further, a side on which the photosensitive drum 103Y for forming an electrostatic latent image of a yellow toner image is arranged is defined as a right side when the photosensitive drum 103K for forming an electrostatic latent image of a black toner image is taken as a reference. A side on which the photosensitive drum 103K for forming an electrostatic latent image of a black toner image is arranged is defined as a left side when the photosensitive drum 103Y for forming an electrostatic latent image of a yellow toner image is taken as a reference. Further, a vertically upper direction perpendicular to the above-defined front-rear direction and the right-left direction is defined as an upper direction, and a vertically lower direction perpendicular to the front-rear direction and the right-left direction is defined as a lower direction. The front direction, the rear direction, the right direction, the left direction, the upper direction, and the lower direction defined as the above are illustrated in FIG. 2B. Further, the rotation axis line direction of the photosensitive drum 103 described below is a direction substantially conforming to the front-rear direction illustrated in FIG. 2B.

<Optical Print Head>

A configuration of the optical print head and its peripheries will be described in detail. There is a laser beam scanning exposure system as an example of an exposure system employed for an electro-photographic image forming apparatus. In the laser beam scanning exposure system, an irradiation light beam output from a semiconductor laser device is deflected on a rotating polygon mirror, and a photosensitive drum is exposed to and scanned with the irradiation light beam via an f-θ lens. The present exemplary embodiment uses the optical print head 105 for a light-emitting diode (LED) exposure system in which the photosensitive drum 103 is exposed to light by using light emitting elements such as LEDs arrayed in the rotation axis line direction of the photosensitive drum 103, and is not used for the above-described laser beam scanning exposure system.

The optical print head 105 described in the present exemplary embodiment is arranged further on the lower side than the rotation axis line of the photosensitive drum 103 in the vertical direction, and LEDs 503 included in the optical print head 105 expose the photosensitive drum 103 to light from underneath. However, the optical print head 105 may be arranged further on the upper side than the rotation axis line of the photosensitive drum 103 in the vertical direction, so that the photosensitive drum 103 is exposed to light from above.

Figure 3:
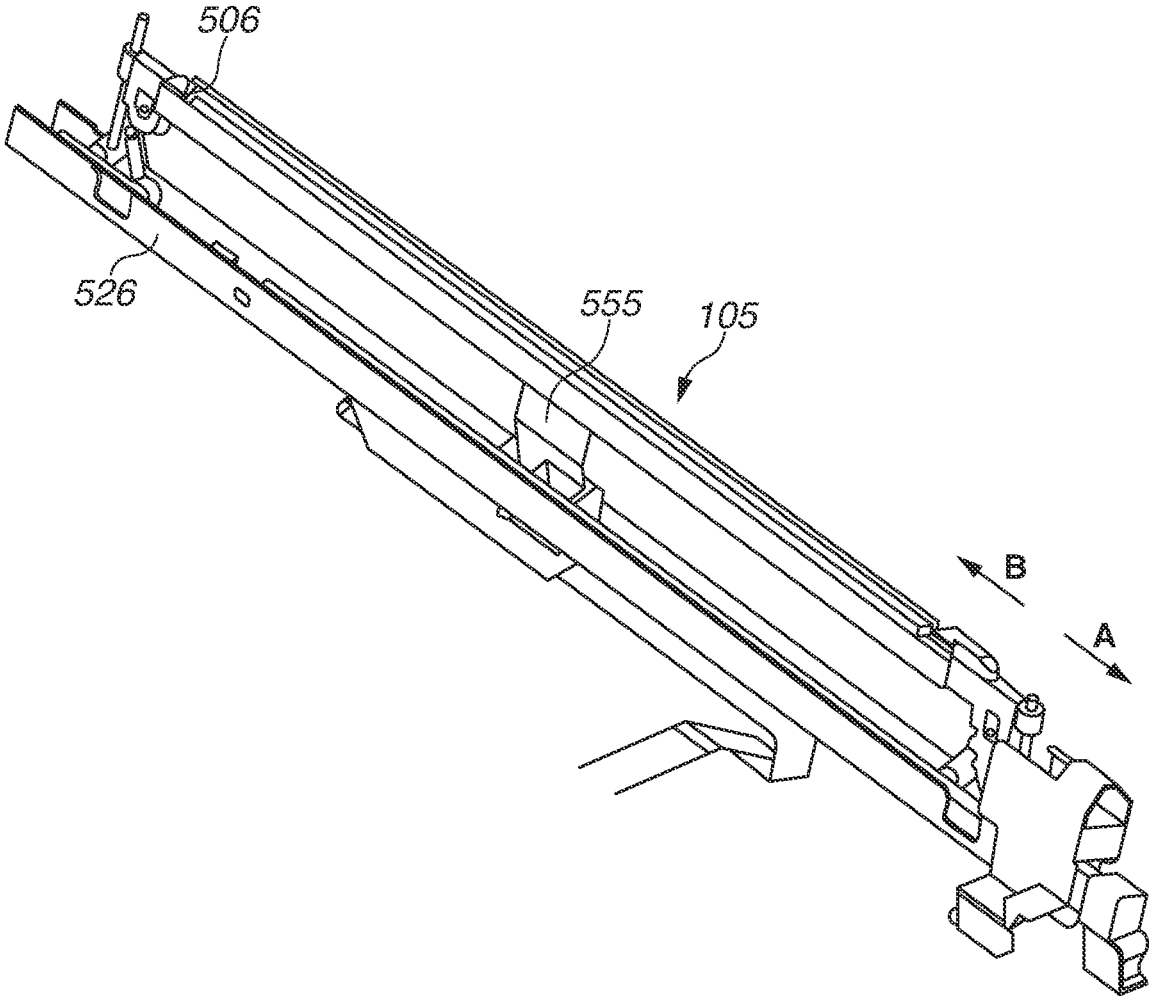
FIG. 3 is a diagram illustrating a configuration of an optical print head.

FIG. 3 is a diagram illustrating a configuration of the optical print head 105. The optical print head 105 includes a substrate (not illustrated) and a lens array 506. While details will be described below, a plurality of light emitting elements, such as light emitting diodes (LEDs), are arranged on the substrate (not illustrated) in a lengthwise direction of the optical print head 105. Further, a connector (not illustrated) to which the cable 555 is detachably connected is arranged on the substrate. A driving signal for driving the light emitting elements such as the LEDs is transmitted to the substrate via the cable 555. The lens array 506 condenses light emitted from the light emitting elements to the surface of the photosensitive drum 103.

Further, both ends of the optical print head 105 in the lengthwise direction of the optical print head 105 are supported by a first supporting member 526 (one example of the first supporting unit). An opening (not illustrated) is formed on the first supporting member 526, and the cable 555 is connected to the connector of the substrate included in the optical print head 105 via the opening.

Figure 4:
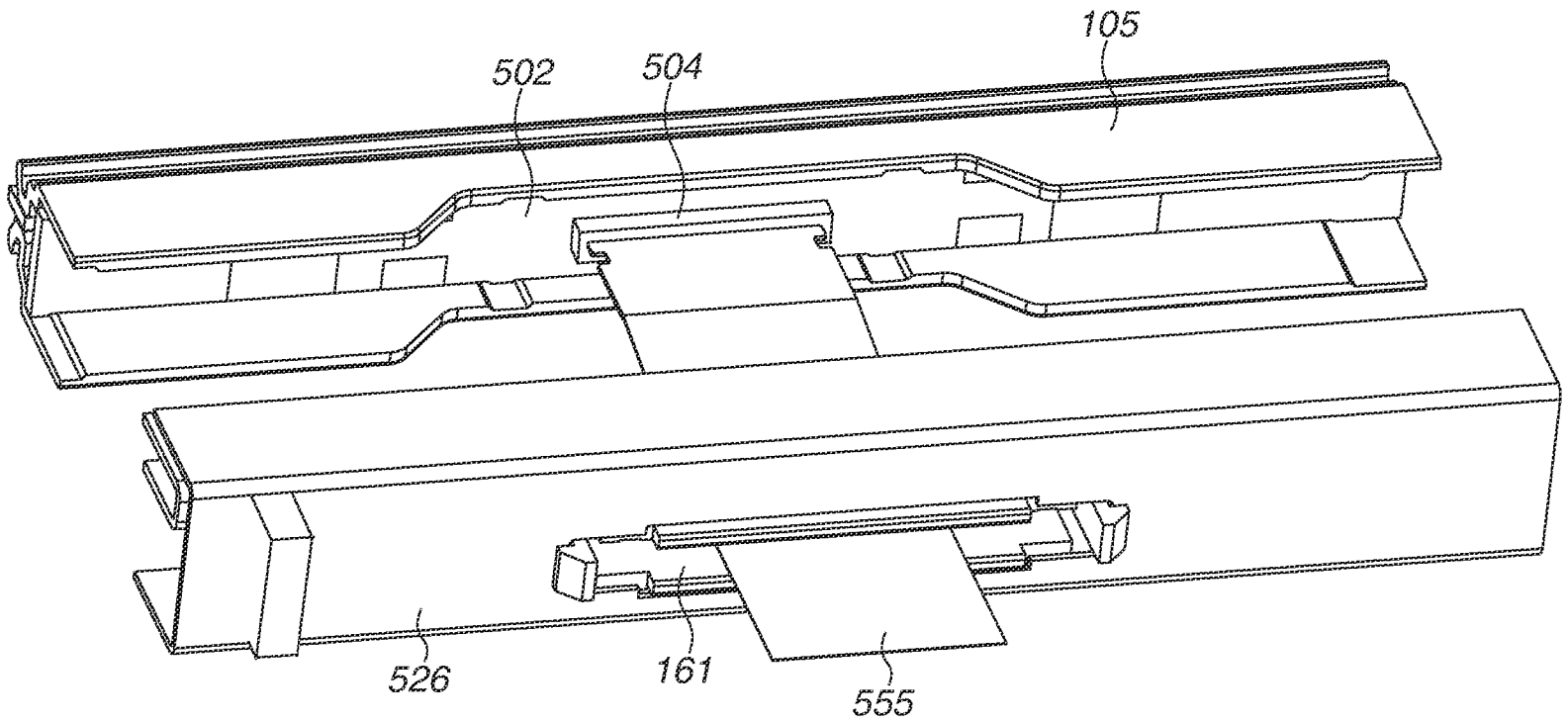
FIG. 4 is a diagram illustrating an opening formed on a first supporting member.

FIG. 4 is a diagram illustrating an opening 161 formed on the first supporting member 526. As described above, the opening 161 as a through-hole penetrating through the first supporting member 526 is formed on the first supporting member 526. In a state where the first supporting member 526 is mounted on the image forming apparatus 1000, the opening 161 is formed on a bottom face on the lower side in the vertical direction of the first supporting member 526. Further, the opening 161 is formed on the first supporting member 526 at a portion that faces a connector 504 of a substrate 502. In the present exemplary embodiment, the opening 161 is a rectangular-shaped hole having a longer side of 70 mm and a shorter side of 10 mm. The cable 555 connected to the connector 504 of the substrate 502 included in the optical print head 105 passes through the opening 161.

Figure 5A:
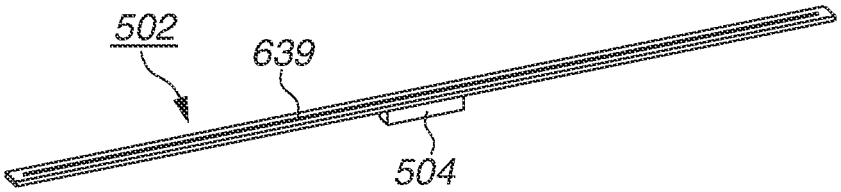
Figure 5A:
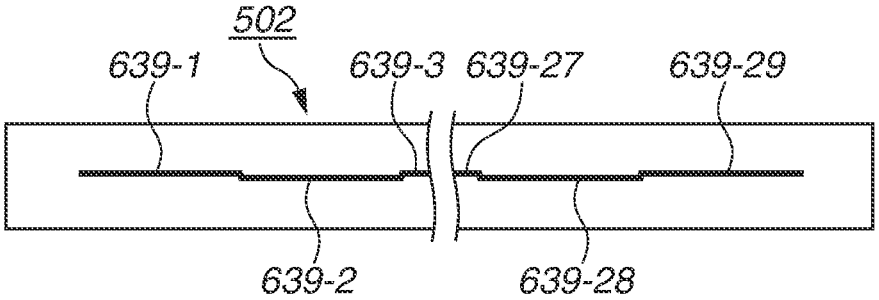
Figure 5A:
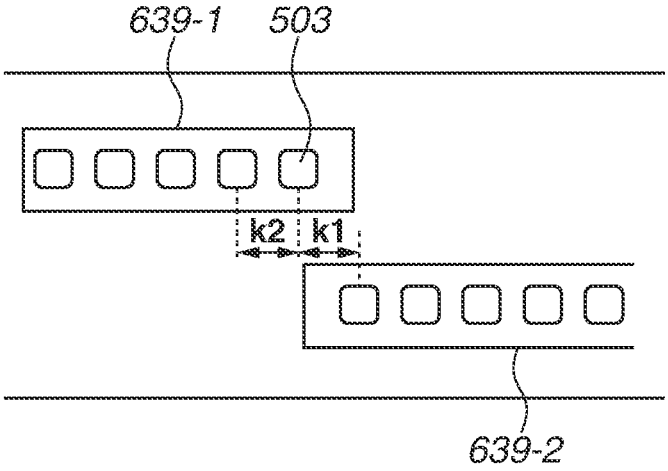
Figure 5A:
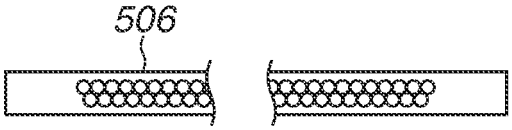
Figure 5A:
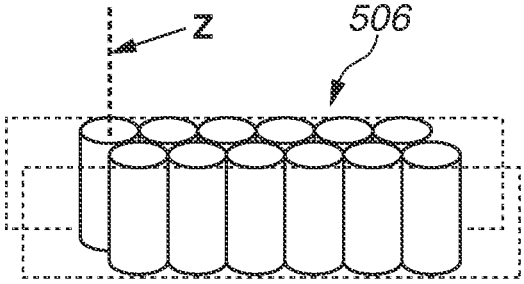

FIG. 5A is a schematic perspective diagram illustrating the substrate 502. FIG. 5B 1 is a diagram illustrating an LED chip 639 mounted on the substrate 502. FIG. 5B2 is a diagram illustrating a plurality of LEDs 503 (one example of light emitting elements) included in the LED chip 639. FIG. 5B2 is an enlarged diagram of FIG. 5B 1.

As illustrated in FIG. 5A, the LED chip 639 is arranged on one of the faces of the substrate 502, and the long connector 504 is arranged on another face opposite to the face on which the LED chip 639 is arranged. The connector 504 is arranged on the lower side face of the substrate 502. The lengthwise direction of the connector 504 and the lengthwise direction of the substrate 502 conform to each other. A circuit pattern for supplying a signal to respective LED chips 639 is arranged on the substrate 502. While details will be described below, a flexible flat cable (i.e., a cable configured of a plurality of conductors covered with a film-like insulating material) as one example of the cable 555 is connected to the connector 504.

The image forming apparatus 1000 includes a control unit (not illustrated) as an example of the main body substrate which controls a driving signal for driving the plurality of LEDs 503. A driving signal is input to the substrate 502 included in the optical print head 105 from the control unit (main body substrate) via the cable 555.

The LED chip 639 mounted on the substrate 502 will be described further in detail. As illustrated in FIGS. 5B 1 and 5B2, a plurality of LED chips 639-1 to 639-29 (29 pieces) on which a plurality of LEDs 503 is arranged is arrayed on one of the faces of the substrate 502. Each of the LED chips 639-1 to 639-29 includes 516 pieces of LEDs 503 arrayed in a row in a lengthwise direction thereof. In the lengthwise direction of the LED chip 639, a center-to-center distance k2 of adjacent LEDs 503 corresponds to the resolution of the image forming apparatus 1000. The image forming apparatus 1000 of the present exemplary embodiment has resolution of 12000 dpi. Therefore, in each of the LED chips 639-1 to 639-29, the LEDs 503 are arrayed in one row at a center-to-center distance of 21.16 micrometer (μm) between the adjacent LEDs 503 in the lengthwise direction of the substrate 502. Accordingly, the optical print head 105 of the present exemplary embodiment has an exposure range of approximately 314 mm. A photosensitive layer of the photosensitive drum 103 is formed to have a width of 314 mm or more. Because a length of a longer side of an A4-size recording sheet and a length of a shorter side of an A3-size recording sheet are 297 mm, the optical print head 105 of the present exemplary embodiment has an exposure range which makes it possible to form an image on the A4-size recording sheet or the A3-size recording sheet.

The LED chips 639-1 to 639-29 are alternately arranged in two rows in the rotation axis line direction of the photosensitive drum 103. In other words, as illustrated in FIG. 5B2, counted from the left side, the odd-numbered LED chips 639-1, 639-3, . . . and 639-29 are mounted in one row in the lengthwise direction of the substrate 502, and the even-numbered LED chips 639-2, 639-4, . . . , 639-28 are mounted in one row in the lengthwise direction of the substrate 502. By arranging the LED chips 639 in the above-described state, as illustrated in FIG. 5B2, a center-to-center distance k1 between one LED arranged on one end of one LED chip 639 and another LED arranged on one end of another LED chip 639 adjacent to and different from the one LED chip 639 in the lengthwise direction of the LED chip 639 can be made equal to the center-to-center distance k2 between adjacent LEDs 503 arranged on a single LED chip 639. In addition, in the present exemplary embodiment, while a configuration employing the LED 503 as an exposure light source is described as an example, an organic electroluminescence (EL) may be employed as the exposure light source.

Subsequently, the lens array 506 will be described. FIG. 5C1 is a diagram schematically illustrating the lens array 506 viewed from a side of the photosensitive drum 103. FIG. 5C2 is a schematic perspective diagram of the lens array 506. As illustrated in FIGS. 5C1 and 5C2, a plurality of lenses is arrayed in two rows in the array direction of the plurality of LEDs 503. Each of the lenses are arranged alternately, so that one of the lenses in one row is in contact with two lenses adjacent in another row in the lens array direction thereof. Each of the lenses is a cylindrical rod lens made of glass. A material of the lens is not limited to glass, and may be plastic. A shape of the lens is not limited to a cylindrical shape, and may be a polygonal columnar shape such as a hexagonal columnar shape.

Light emitted from the LEDs 503 is incident on the lenses of the lens array 506. Each of the lenses has a function for condensing the emitted light incident thereon to the surface of the photosensitive drum 103. The optical print head 105 is assembled in such a state that a distance between a light emitting face of the LED 503 and a light incidence face of the lens becomes substantially equal to a distance between a light output face of the lens and a surface of the photosensitive drum 103.

<Configuration for Attaching or Detaching Optical Print Head to/from Image Forming Apparatus Main Body>

Figure 6:
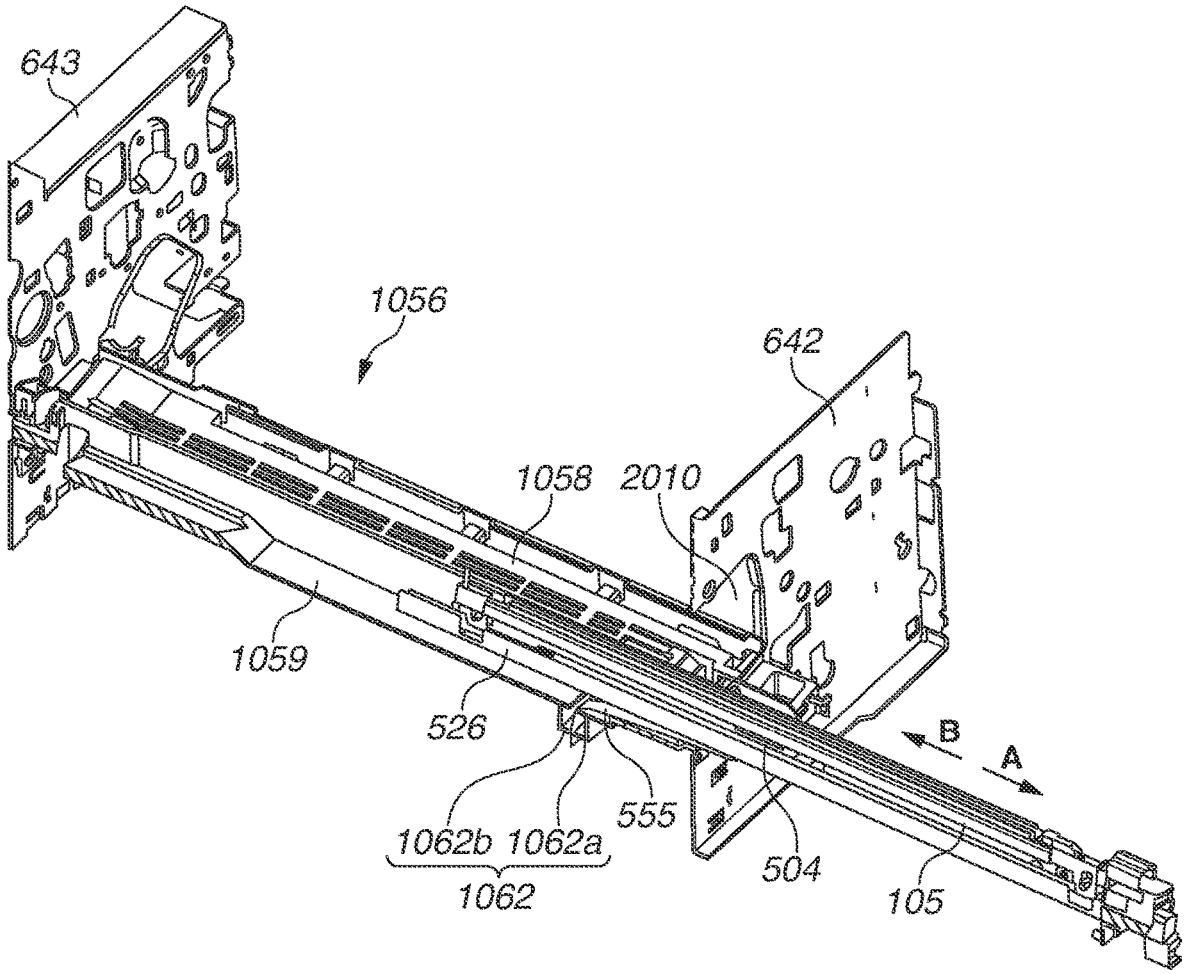
FIG. 6 is a diagram illustrating the first supporting member.

FIG. 6 is a diagram illustrating a state where the first supporting member 526 is extracted from the main body of the image forming apparatus 1000 together with the optical print head 105 by an engineer such as a user or a service engineer. As illustrated in FIG. 6, the engineer can extract the first supporting member 526 from the main body of the image forming apparatus 1000 by making the first supporting member 526 slide and move in the rotation axis line direction of the photosensitive drum 103. When the first supporting member 526 is to be extracted from the main body of the image forming apparatus 1000, the engineer moves the first supporting member 526 in an arrow-A direction. On the other hand, when the first supporting member 526 is to be mounted on the image forming apparatus 1000, the engineer moves the first supporting member 526 in an arrow-B direction. The arrow-A direction conforms to a direction in which the first supporting member 526 is extracted from the main body of the image forming apparatus 1000. The first supporting member 526 is moved in the arrow-A direction and the arrow-B direction via the opening 2010 formed on the front-side plate 642. Herein, a position where the first supporting member 526 is mounted on the main body of the image forming apparatus 1000 in order to expose the photosensitive drum 103 to light is defined as a mounting position. Further, a position to which the first supporting member 526 is moved from the mounting position in the arrow-A direction, where at least a part of the connector 504 is positioned further on the downstream side than the opening 2010 in the arrow-A direction, is defined as an extraction position. In a case where the engineer has to take out the optical print head 105 from the main body of the image forming apparatus 1000 in order to replace the substrate 502, the engineer moves the first supporting member 526 to the extraction position and detaches the cable 555 from the connector 504 by operating the connector 504. Thereafter, by further extracting the first supporting member 526 in the arrow-A direction, the first supporting member 526 and the optical print head 105 can be detached from the main body of the image forming apparatus 1000.

Next, the second supporting member 1056 as one example of the second supporting unit will be described with reference to FIG. 6. One end of the second supporting member 1056 on the front side of the main body of the image forming apparatus 1000 is fixed to the front-side plate 642 with a screw. Further, another end of the second supporting member 1056 on the rear side of the main body of the image forming apparatus 1000 is fixed to the rear-side plate 643 with a screw. The second supporting member 1056 has a function of guiding the movement of the first supporting member 526 that is inserted to the inner portion of the main body of the image forming apparatus 1000 from the outside through an opening 2010 formed on the front-side plate 642. In other words, the second supporting member 1056 has a function of guiding the movement of the first supporting member 526 that is moved from the extraction position to the mounting position or from the mounting position to the extraction position. When the first supporting member 526 is being moved from the extraction position to the mounting position or from the mounting position to the extraction position by the engineer, the first supporting member 526 is upwardly supported by the second supporting member 1056 from underneath in the vertical direction. In the present exemplary embodiment, the first supporting member 526 positioned at the mounting position is determined and supported only by the front-side plate 642 and the rear-side plate 643. Therefore, the first supporting member 526 positioned at the mounting position is not supported by the second supporting member 1056. This allows the first supporting member 526 to be positioned more precisely relative to the photosensitive drum 103. If a position of the first supporting member 526 is fixed relative to the second supporting member 1056 that is fixed to the front-side plate 642 and the rear-side plate 643, the first supporting member 526 is positioned relative to the front-side plate 642 and the rear-side plate 643 with one extra member (in this case, the second supporting member 1056) therebetween. The second supporting member 1056 is arranged inside the main body of the image forming apparatus 1000 with respect to each of the four image forming units 102Y, 102M, 102C, and 102K.

Further, as illustrated in FIG. 6, the second supporting member 1056 includes guide units 1058 and 1059. The guide unit 1058 has a function of guiding the movement of the drum unit 518 (see FIG. 2) inserted to the inner portion of the main body of the image forming apparatus 1000 via the opening 2010 of the front-side plate 642. The guide unit 1058 has a shape that follows a shape of the lower portion of the drum unit 518. Therefore, the drum unit 518 that is inserted toward a rear side from a front-side of the main body of the image forming apparatus 1000 via the opening 2010 of the front-side plate 642 fits the guide unit 1058 with slight play. In a state where the lower portion of the drum unit 518 fits the guide unit 1058, the engineer further presses the drum unit 518 toward the rear side from the front-side of the main body of the image forming apparatus 1000. Therefore, the drum unit 518 is moved toward the rear side from the front-side of the main body of the image forming apparatus 1000 along the guide unit 1058, and mounted on the main body of the image forming apparatus 1000.

On the other hand, the guide unit 1059 has a function of guiding the movement of the optical print head 105 inserted to the inner portion of the main body of the image forming apparatus 1000 via the opening 2010 of the front-side plate 642. In a case where malfunction arises in the substrate 502, the engineer has to replace or repair the optical print head 105 in order to maintain its performance. Therefore, the optical print head 105 has to be interchangeable with respect to the image forming apparatus 1000.

The guide unit 1059 has a shape that follows a shape of the lower portion of the first supporting member 526. Therefore, the first supporting member 526 inserted toward the rear side from the front side of the main body of the image forming apparatus 1000 via the opening 2010 of the front-side plate 642 fits the guide unit 1059 with slight play. In a state where the lower portion of the first supporting member 526 fits the guide unit 1059, the engineer further presses the first supporting member 526 toward the rear side from the front side of the main body of the image forming apparatus 1000. Therefore, the first supporting member 526 is moved toward the rear side from the front side of the main body of the image forming apparatus 1000 along the guide unit 1059, and an end portion on the rear side of the first supporting member 526 fits an opening (not illustrated) formed on the rear-side plate 643. In other words, by moving the optical print head 105 from the front side to the rear side of the main body of the image forming apparatus 1000 in a state where the optical print head 105 fits the guide unit 1059, the engineer can position the first supporting member 526 to the image forming apparatus 1000 with certainty.

Next, a function of a regulation portion 1062 (one example of a holding portion) arranged on the lower side of the second supporting member 1056 will be described. As illustrated in FIG. 6, the regulation portion 1062 includes a first wall portion 1062*a* and a second wall portion 1062*b*. A cable 555 is wired on the upper side of the second supporting member 1056 toward a side lower than the second supporting member 1056 via a hole 1056*a*, and the first wall portion 1062*a* is a member that pinches and holds the cable 555 with the second wall portion 1062*b* on the front side and a rear side of the cable 555. In a state where the first supporting member 526 is positioned at the mounting position, this regulation portion 1062 is arranged further on a downstream side than the below-described abutting portion 662 in a direction in which the first supporting member 526 is extracted. The cable 555 is attached to the second supporting member 1056 by being pinched and held by the first wall portion 1062*a* and the second wall portion 1062*b*. The first wall portion 1062*a* has flexibility, so that a leading end thereof (i.e., a portion that is in contact with the cable 555) is constantly urged against the second wall portion 1062*b*. With this configuration, the cable 555 is pinched between the first wall portion 1062*a* and the second wall portion 1062*b* in the rotation axis line direction of the photosensitive drum 103, so that a movement of the cable 555 from the front side to the rear side or from the rear side to the front side of the main body of the image forming apparatus 1000 is regulated. A configuration of the regulation portion 1062 is not limited to the above. The second wall portion 1062*b* may have flexibility, so that the second wall portion 1062*b* is urged against the first wall portion 1062*a*. Alternatively, both of the first and the second wall portions 1062*a* and 1062*b* may be urged against one another. Further, for example, the second wall portion 1062*b* may be taken away, so that the first wall portion 1062*a* is urged against the lower side of the second supporting member 1056. In this case, the cable 555 is attached to the second supporting member 1056 being pinched between the first wall portion 1062*a* and the lower side of the second supporting member 1056 in the vertical direction. In the present exemplary embodiment, although the cable 555 is pinched between the first wall portion 1062*a* and the second wall portion 1062*b*, the cable 555 can be moved in a pinched state. The regulation portion 1062 is required to function as a portion that regulates a movement of a part of the cable 555 from the rear side to the front side of the main body of the image forming apparatus 1000. Therefore, the cable 555 may be fixed to the regulation portion 1062 with an adhesive agent or a double-sided tape, with an allowance of a certain moving amount (e.g., movement of several tens of millimeters).

The regulation portion 1062 does not have to be arranged on the second supporting member 1056. The regulation portion 1062 may be arranged further on the rear side of the main body of the image forming apparatus 1000 than the front-side plate 642 and further on the front side of the main body of the image forming apparatus 1000 than the rear-side plate 643. For example, a position on the rear side of the front-side plate 642 or a position on the front side of the rear-side plate 643 may be considered as a position where the regulation portion 1062 is to be arranged. For example, if a relay substrate to which another end of the cable 555 is connected is arranged further on the rear side of the main body of the image forming apparatus 1000 than the rear-side plate 643, the cable 555 extending from the relay substrate is wired from the rear-side plate 643 to the front side thereof via a hole formed on the rear-side plate 643. Herein, the above-described relay substrate has a function for relaying a driving signal transmitted to the substrate 502 from the control unit that controls driving voltage for driving the LED 503. Another end of the cable 555 may be directly connected to the control unit (not illustrated) instead of being connected to the relay substrate. The cable 555 extending toward the front side from the hole formed on the rear-side plate 643 is connected to the connector 504 of the substrate 502 via the hole 1056*a* formed on the second supporting member 1056.

Figure 7:
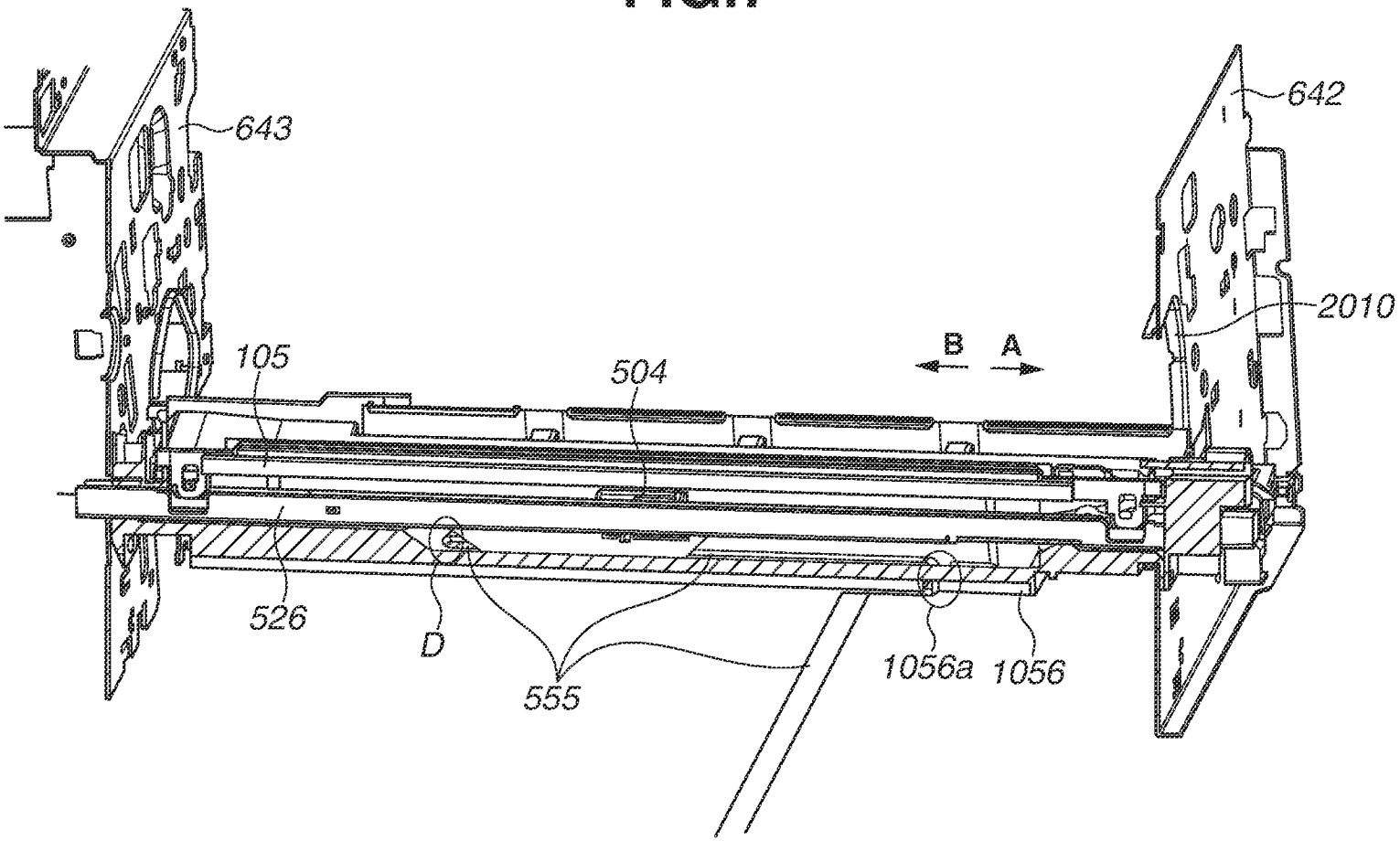
FIG. 7 is a diagram illustrating the first supporting member positioned at a mounting position.

FIG. 7 is a schematic perspective diagram illustrating a state where the first supporting member 526 is positioned at the mounting position. In FIG. 7, the regulation portion 1062 is not illustrated. Further, the cable 555 for electrically connecting the control unit (not illustrated) and the connector 504 passes through the hole 1056*a* formed on the second supporting member 1056. The hole 1056*a* will be described below in detail. Wiring of the cable 555 will be described with reference to FIG. 7. The cable 555 connected to the connector 504 passes through the opening 161 (not illustrated) formed on the first supporting member 526, and extends from the connector 504 toward the lower side in the vertical direction. The cable 555 further extends from the opening 161 (not illustrated) toward the rear side of the main body of the image forming apparatus 1000 in the lengthwise direction of the first supporting member 526 (i.e., the rotation axis line direction of the photosensitive drum 103), and is folded at a portion illustrated in an area D. With this configuration, the cable 555 is curved in one area, so that a curved area (area D) is formed on the cable 555. The cable 555 that is folded in the area D extends toward the regulation portion 1062 formed on the front side of the second supporting member 1056 along the guide unit 1059 of the second supporting member 1056. In the curved area D where the cable 555 is curved, the cable 555 is in contact with the first supporting member 526 and the guide unit 1059 of the second supporting member 1056. Hereinafter, the area D is called as a curved portion D (one area of the cable 555) formed on the cable 555.

Figure 8:
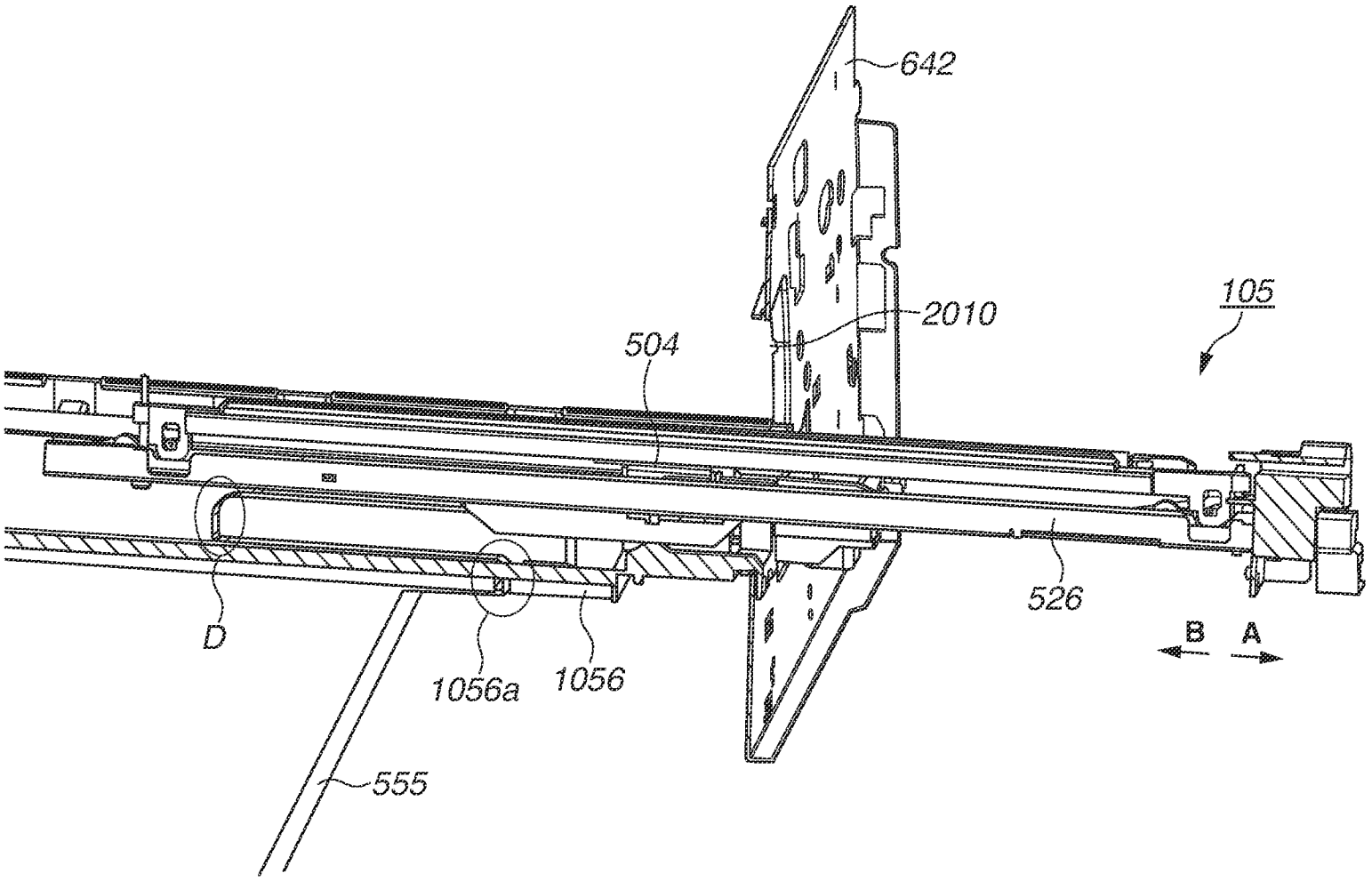
FIG. 8 is a diagram illustrating the first supporting member being moved toward an extraction position from a mounting position.

FIG. 8 is a diagram illustrating a state where the first supporting member 526 is being moved to the extraction position from the mounting position. For the sake of simplicity, the regulation portion 1062 illustrated in FIG. 6 is not illustrated in FIG. 8. As illustrated in FIG. 8, the curved portion D formed on the cable 555 is moved in the arrow-A direction together with the first supporting member 526 movable in the arrow-A direction. A movement of the cable 555 is regulated by the regulation portion 1062 (not illustrated). In other words, as illustrated in the area D in FIG. 8, the first supporting member 526 can be extracted in the arrow-A direction because the cable 555 is warped. The curved portion D formed on the cable 555 is curved toward the rear side of the main body of the image forming apparatus 1000 in the rotation axis line direction of the photosensitive drum 103. From the state illustrated in FIG. 8, the engineer further moves the first supporting member 526 to the extraction position in the arrow-A direction.

Figure 9:
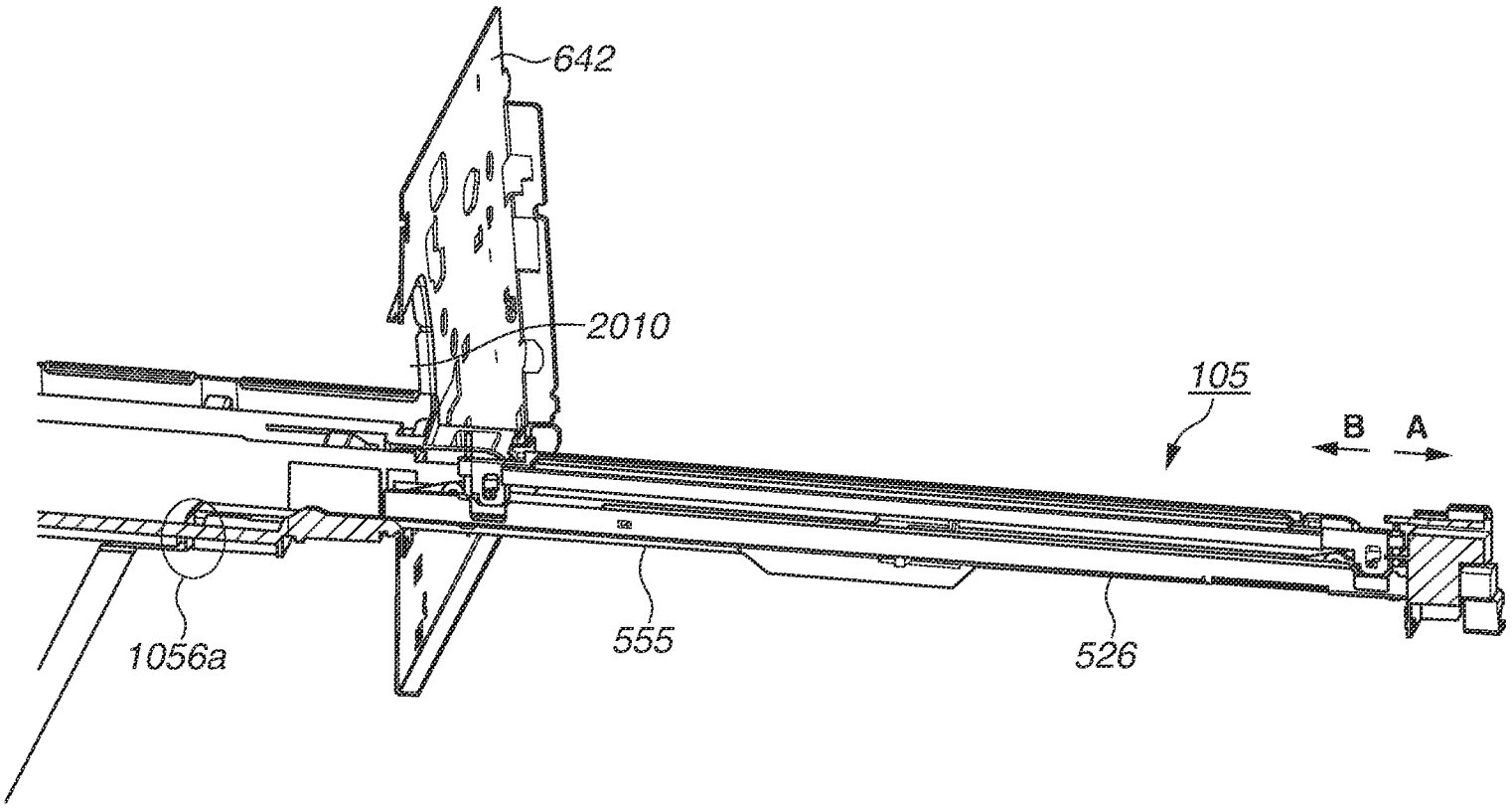
FIG. 9 is a diagram illustrating the first supporting member positioned at an extraction position.

FIG. 9 is a diagram illustrating a state where the first supporting member 526 is moved to the extraction position. As illustrated in FIG. 9, when the first supporting member 526 is positioned at the extraction position, the connector 504 is positioned further on the front side than the opening 2010 of the front-side plate 642. In this state, the engineer detaches the cable 555 from the connector 504. Thereafter, the engineer further extracts the first supporting member 526 in the arrow-A direction, so that the first supporting member 526 and the optical print head 105 can be detached from the main body of the image forming apparatus 1000. When the first supporting member 526 is positioned at the extraction position, the cable 555 is folded and in contact with the edge of the hole 1056*a*.

Figure 10:
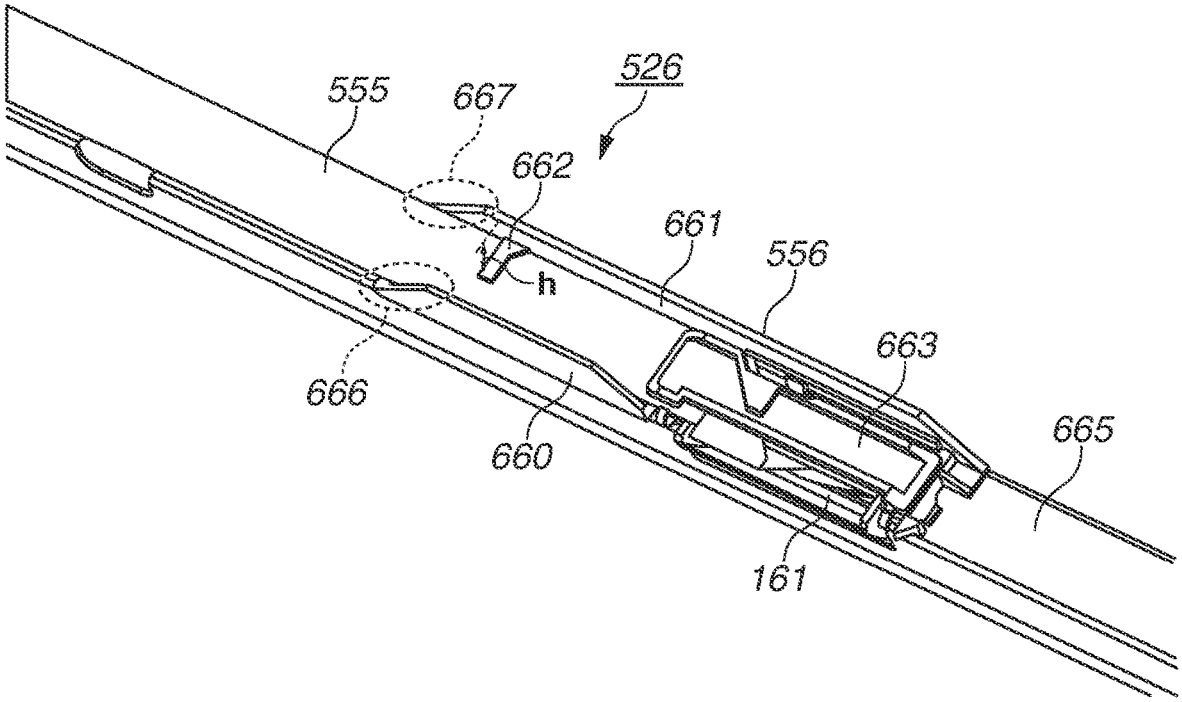
FIG. 10 is a diagram illustrating a cable guide member arranged on the first supporting member.

FIG. 10 is a diagram illustrating a cable guide member 556 attached to the edge of the opening 161 of the first supporting member 526. The cable guide member 556 having a snap-fit structure is attached to the opening 161 formed on a bottom face portion 665 of the first supporting member 526. As illustrated in FIG. 10, the cable guide member 556 includes a first wall portion 660, a second wall portion 661, an abutting portion 662, and a cover 663. The cable 555 extending from the opening 161 to the lower side of the first supporting member 526 is folded at the opening 161 and pressed against the bottom face portion 665 of the first supporting member 526 with the cover 663. With this configuration, the cable 555 is held between the cover 663 and the first supporting member 526. The cable 555 held between the cover 663 and the first supporting member 526 is wired in the lengthwise direction of the first supporting member 526, toward a direction opposite to the direction in which the first supporting member 526 is extracted (i.e., a direction toward the front side of the main body of the image forming apparatus 1000).

The first wall portion 660 and the second wall portion 661 of the cable guide member 556 are respectively projected in a direction perpendicular to the bottom face portion 665 of the first supporting member 526. A projection (hereinafter, called as "abutting portion 662") projected in a direction (i.e., perpendicular direction) perpendicular to both of the projection direction of the second wall portion 661 and the lengthwise direction of the first supporting member 526 is formed on the second wall portion 661. In other words, a positional relationship between the first wall portion 660, the second wall portion 661, and the abutting portion 662 is such that the first wall portion 660 is positioned further on one side than the abutting portion 662, whereas the second wall portion 661 is positioned further on another side than the abutting portion 662 in a direction perpendicular to both of the vertical direction and the rotation axis line direction of the photosensitive drum 103. The abutting portion 662 is fixed to the first supporting member 526 further on the upstream side than the opening 161 in a direction (i.e., arrow-A direction) in which the first supporting member 526 is extracted. The cable 555 coming out from the opening 161 and held between the cover 663 and the bottom face portion 665 of the first supporting member 526 is wired in an area between the first wall portion 660 and the second wall portion 661. Both of the first wall portion 660 and the second wall portion 661 overlap with the cable 555 in a perpendicular direction that is a direction in which the abutting portion 662 extends. Further, the abutting portion 662 is arranged on the second wall portion 661 further on the lower side than the cable 555 wired in the area between the first wall portion 660 and the second wall portion 661. Therefore, the abutting portion 662 supports the cable 555 from underneath in the vertical direction. In other words, the cable 555 is wired in an area between the abutting portion 662 and the bottom face portion 665 in the vertical direction. Herein, the abutting portion 662 may be arranged on the first wall portion 660 instead of the second wall portion 661. In this case, the abutting portion 662 is a projection projected toward the second wall portion 661 from the first wall portion 660. Further, the abutting portion 662 may connect the first wall portion 660 and the second wall portion 661. In other words, the abutting portion 662 may serve as a member that connects the first wall portion 660 and the second wall portion 661 in the perpendicular direction perpendicular to both of the rotation axis line direction of the photosensitive drum 103 and the vertical direction.

With the above-described configuration, a part of the cable 555 is supported by the abutting portion 662 further on the upstream side than the opening 161 in a direction in which the first supporting member 526 is extracted, and the cable 555 is wired from the opening 161 toward the rear side of the main body of the image forming apparatus 1000.

Further, as indicated by an arrow h in FIG. 10, the first wall portion 660 and the second wall portion 661 are projected further on the lower side than the abutting portion 662 in the vertical direction by a distance h. In the present exemplary embodiment, the distance h is 5 mm. While details will be described below, with this configuration, when the first supporting member 526 is moved from the extraction position toward the mounting position, the cable 555 can be prevented from being nipped between the abutting portion 662 and the lower edge of the opening 2010 formed on the front-side plate 642.

Further, as illustrated in FIG. 10, an inclined face 666 is formed on an end portion on the front side of the first wall portion 660, and an inclined face 667 is formed on an end portion on the front side of the second wall portion 661. Each of the inclined faces 666 and 667 is inclined toward the bottom face portion 665 of the first supporting member 526 in a direction opposite to a direction in which the first supporting member 526 is extracted from the image forming apparatus 1000. In the present exemplary embodiment, each of inclined angles of the inclined faces 666 and 667 with respect to the bottom face portion 665 is 10 degrees or more and 40 degrees or less. When the first supporting member 526 passes through the opening 2010 from the extraction position to the mounting position, the inclined faces 666 and 667 abut on the lower edge in the vertical direction of the opening 2010. With this configuration, a movement of the first supporting member 526 is guided by the inclined faces 666 and 667. Accordingly, the engineer can easily passes the first supporting member 526 through the opening 2010 to move the first supporting member 526 from the extraction position to the mounting position.

Figure 11A:
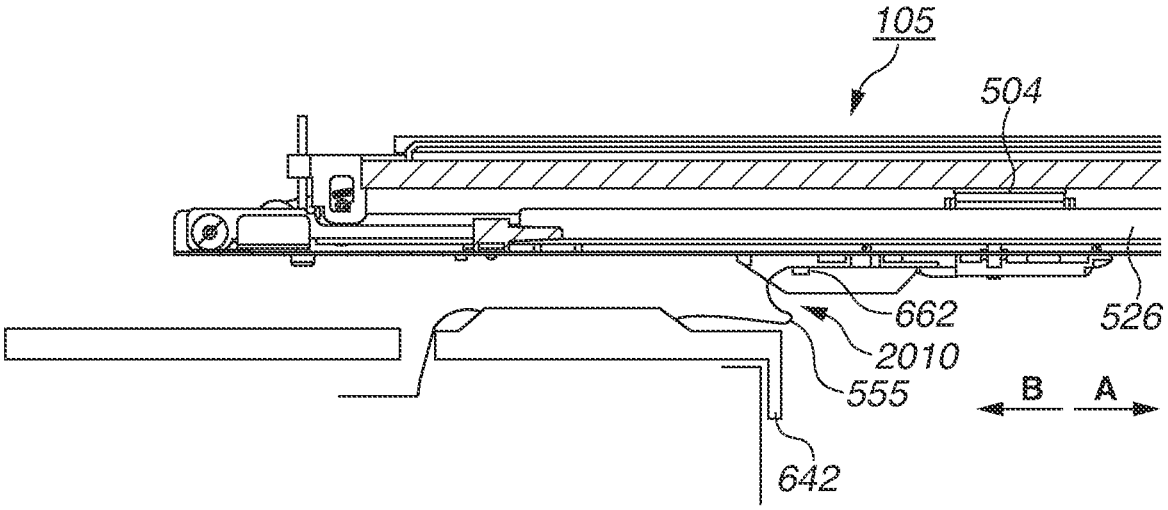
FIGS. 11A and 11B are diagrams illustrating a state of the cable when the first supporting member is moved.

Next, a configuration for moving the first supporting member 526 to the mounting position from the extraction position will be described with reference to FIGS. 11A and 11B. FIG. 11A is a diagram illustrating a state of the first supporting member 526 and the optical print head 105 which are being moved to the mounting position from the extraction position by the engineer.

FIG. 11A illustrates the first supporting member 526 and the optical print head 105 positioned at the extraction position. When the engineer extracts the first supporting member 526 to the extraction position and finishes the replacement work of the substrate 502, as illustrated in FIG. 11A, the cable 555 may hang downward in the vertical direction in a vicinity of the opening 2010 of the front-side plate 642 because of the gravity. It is assumed that the first wall portion 660 and the second wall portion 661 are not projected further on the lower side than the abutting portion 662 in the vertical direction, so that the distance h is 0 mm. In the above-described configuration, when the engineer moves the first supporting member 526 in the arrow-B direction, the cable 555 may be nipped between the abutting portion 662 and the edge on the lower side in the vertical direction of the opening 2010 of the front-side plate 642 in the vertical direction. Thus, there is a risk that the cable 555 is damaged. Therefore, as illustrated in FIG. 10, the first wall portion 660 and the second wall portion 661 are projected much more than the abutting portion 662 by an amount indicated by the arrow h, so that a gap having the distance h is formed at a position between the abutting portion 662 and the edge on the lower side of the opening 2010 of the front-side plate 642. The distance h is sufficiently greater than the thickness of the cable 555 folded in two layers.

Further, as illustrated in FIG. 11A, when the first supporting member 526 is positioned at the extraction position, the cable 555 that extends from the connector 504 toward the regulation portion 1062 (not illustrated) is supported by the abutting portion 662. The abutting portion 662 abuts on the cable 555 in the vertically upper direction to support the cable 555. In the above state, when the engineer moves the first supporting member 526 toward the mounting position, the abutting portion 662 is also moved together with the first supporting member 526. Therefore, the abutting portion 662 abuts on a part of the cable 555 in the arrow-B direction. In a state where the abutting portion 662 abuts on the cable 555 in the arrow-B direction (i.e., a direction toward the mounting position from the extraction position), the cable 555 is moved toward the rear side of the apparatus main body. With this operation, the cable 555 is pressed to the rear side of the main body of the image forming apparatus 1000 by the abutting portion 662.

Figure 11B:
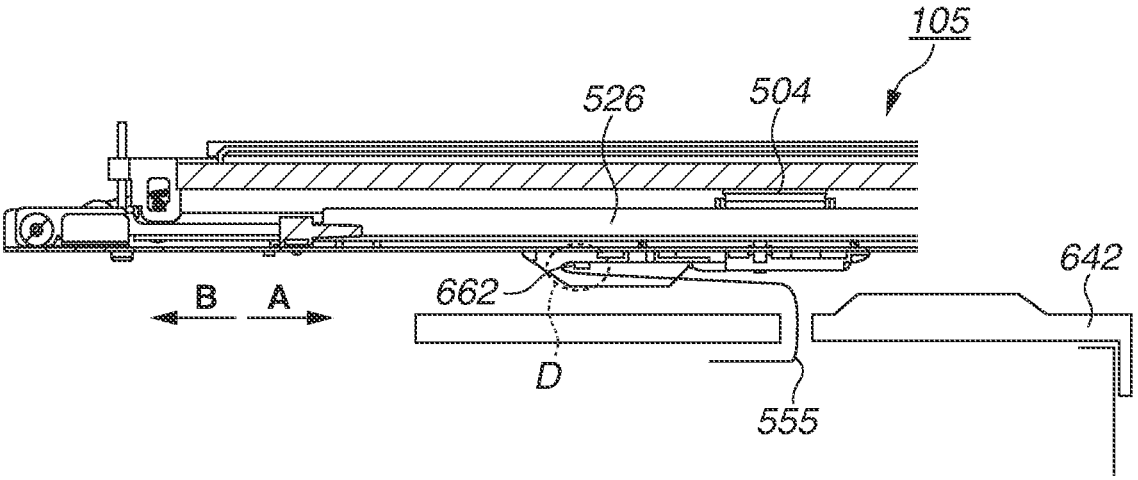

FIG. 11B is a diagram illustrating a state where the first supporting member 526 is positioned at the mounting position. When the first supporting member 526 is moved toward the mounting position from the extraction position, the abutting portion 662 presses the cable 555 to the rear side of the apparatus main body. With this operation, a curved portion warped and curved in the arrow-B direction is formed on the cable 555 at a portion on which the abutting portion 662 abuts.

Figure 12A:
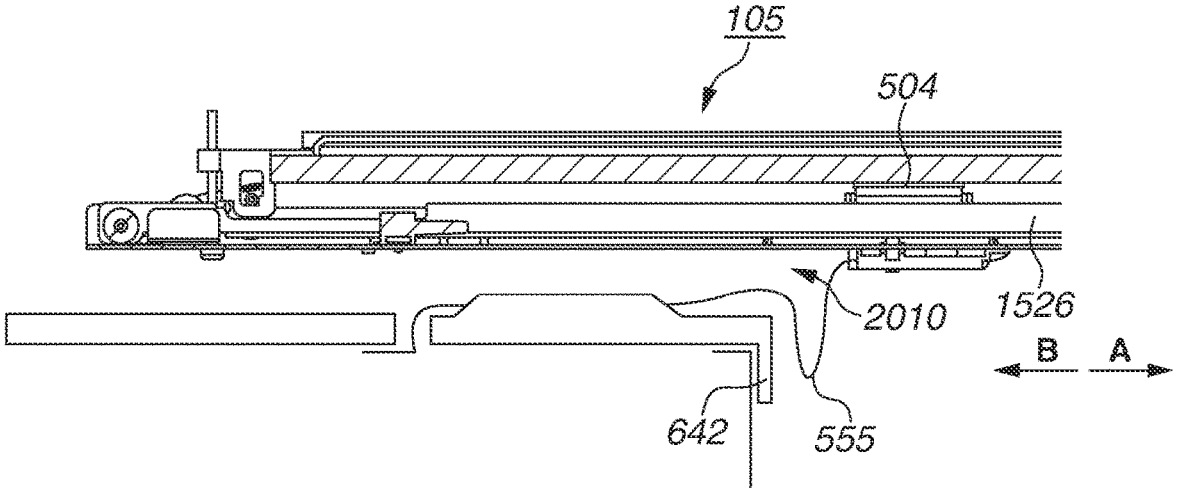
FIGS. 12A and 12B am diagrams illustrating a first supporting member according to a comparison example 1.
Figure 12B:
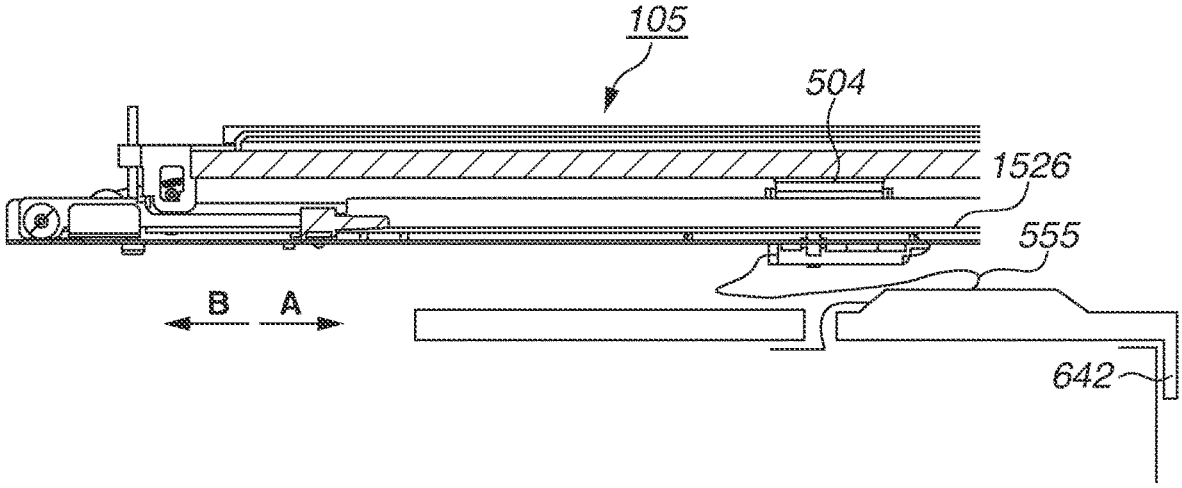

Next, an effect of the abutting portion 662 will be described by using a first supporting member 1526 that is not provided with the abutting portion 662. FIGS. 12A and 12B are diagrams illustrating a comparison example for describing the effect of the abutting portion 662. FIG. 12A illustrates a state where the first supporting member 1526 of the comparison example is positioned at the extraction position. FIG. 12B illustrates a state where the first supporting member 1526 is moved toward the rear side of the main body of the image forming apparatus 1000 from the state illustrated in FIG. 12A and moved to the mounting position. Because the first supporting member 1526 does not have a member corresponding to the abutting portion 662, there is a risk that the cable 555 cannot be stored inside the main body of the image forming apparatus 1000 successfully when the first supporting member 1526 is moved toward the mounting position from the extraction position. In FIG. 11B, although a curved portion is formed on the cable 555 because of the abutting portion 662 abutting thereon, the curved portion is not formed on the cable 555 in FIG. 12B. Because the first supporting member 1526 is inserted to or removed from the main body of the image forming apparatus 1000 by the engineer such as a user or a service engineer, a moving path of the first supporting member 1526 may vary depending on how the engineer performs the operation. Therefore, there is a risk that the curved portion is not formed on the cable 555 at a portion where the curved portion should be formed. It is not possible to estimate a degree of a fold or a warp of the cable 555 to be formed when the first supporting member 1526 is stored inside the main body of the image forming apparatus 1000. Therefore, depending on the operation method of the engineer, there is a risk that the cable 555 is damaged. Because the engineer has to operate the first supporting member 1526 while taking possible damage of the cable 555 into consideration, it is hard to say that the configuration without having the abutting portion 662 described in the comparison example is excellent in terms of operability.

A benefit of a configuration will be described with reference to FIGS. 13A and 13B in which the cable 555 coming out from the opening 161 of the first supporting member 526 is wired in a direction opposite to a direction in which the first supporting member 526 is extracted.

Figure 13A:
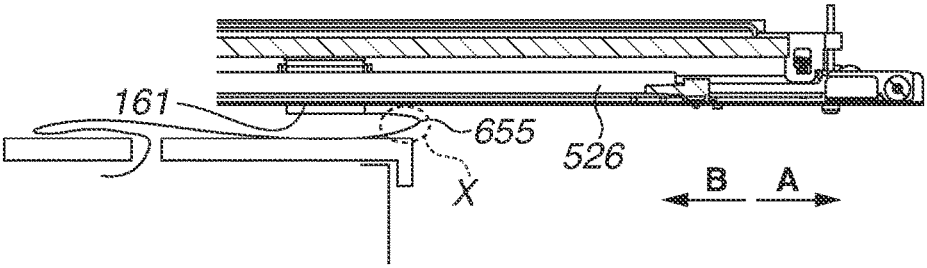
FIGS. 13A and 13B are diagrams illustrating a first supporting member according to a comparison example 2.
Figure 13B:
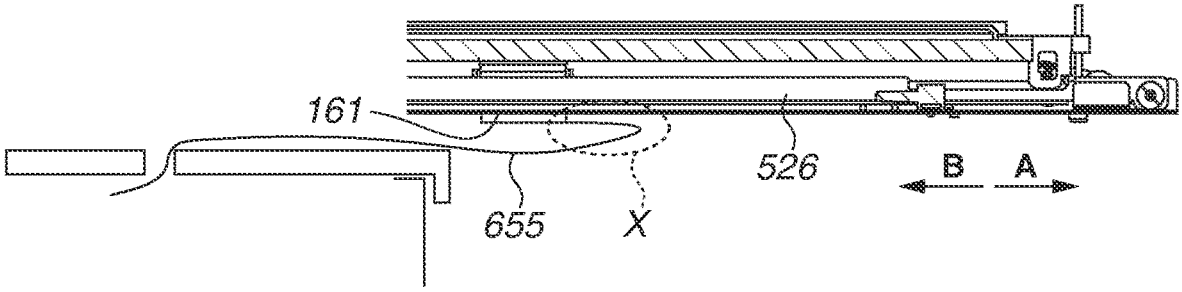

FIGS. 13A and 13B are diagrams illustrating a comparison example where a cable 655 coming out from the opening 161 of the first supporting member 526 is wired in a direction in which the first supporting member 526 is extracted. Each of FIGS. 13A and 13B illustrates a state where the first supporting member 526 is positioned at the extraction position. As illustrated in the area surrounded by a dotted line X, the cable 655 coming out from the opening 161 formed on the first supporting member 526 is folded further on the front side than the opening 161 and extends toward the rear side of the main body of the image forming apparatus 1000. In consideration of an influence of noise or cost, it is preferable that the length of the cable 655 from the control unit (not illustrated) to the connector 504 of the substrate 502 included in the optical print head 105 be shorter.

In the configuration according to the present disclosure in which the cable 555 is wired in a direction opposite to the direction in which the first supporting member 526 is extracted from the opening 161, a portion surrounded by the dotted line X illustrated in FIG. 13A or 13B does not exist. This indicates that a length of the cable 555 according to the configuration of the present disclosure which connects the control unit (not illustrated) and the connector 504 of the substrate 502 can be shorter than the comparison example.

Next, with reference to FIGS. 14A to 14C, a length of the cable 555 between the hole 1056*a* and the connector 504 and a distance between the hole 1056*a* and the opening 2010 of the front-side plate 642 will be described in a state where the first supporting member 526 is mounted on the inner portion of the main body of the image forming apparatus 1000.

Figure 14A:
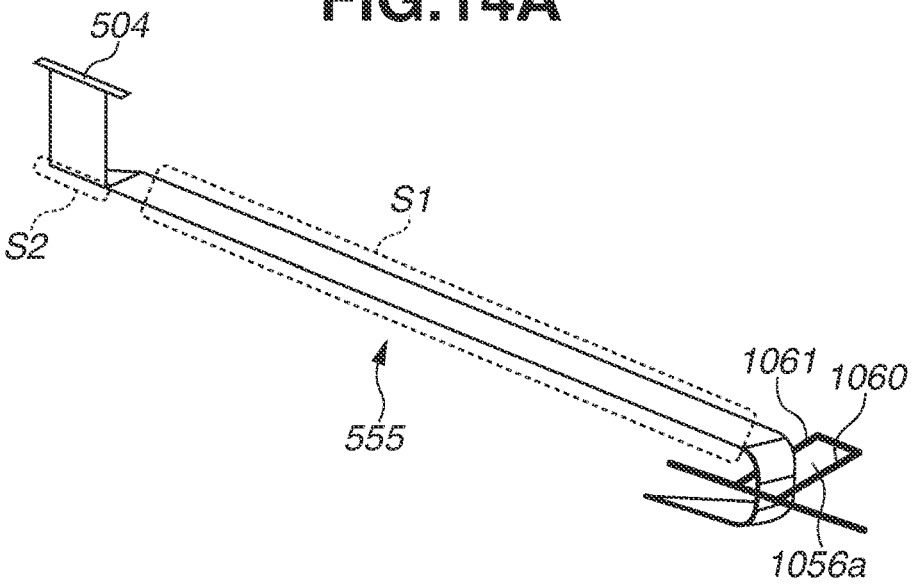
FIGS. 14A, 14B, and 14C are diagrams illustrating a cable.

FIG. 14A is a diagram illustrating the cable 555 extending from the connector 504 to the hole 1056*a* formed on the second supporting member 1056. As illustrated in FIG. 14A, the cable 555 that extends upward from the hole 1056*a* is wired toward the connector 504. In an area S1, the cable 555 is wired along the first supporting member 526 toward the front side of the main body of the image forming apparatus 1000 to face the lower face of the first supporting member 526. Herein, for the sake of simplicity, the cable 555 extending toward the connector 504 is folded toward the upper side approximately orthogonally at the portion indicated by an area S2.

Figure 14B:
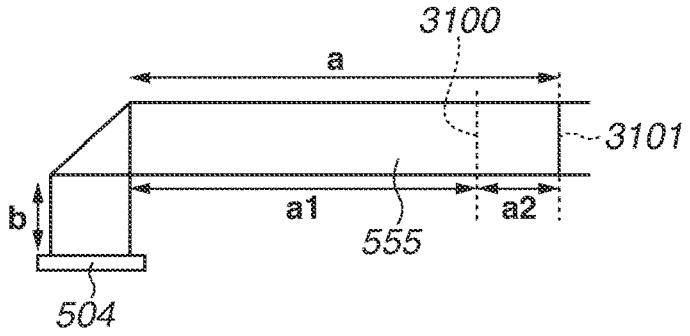

FIG. 14B is a diagram illustrating a state where the folded portion of the cable 555 in the area S2 illustrated in FIG. 14A is unfolded and stretched. Further, FIG. 14C is a cross-sectional diagram of a front side of the second supporting member 1056 and the opening 2010 of the front-side plate 642 vertically cut in the rotation axis line direction of the photosensitive drum 103 in a state where the first supporting member 526 is extracted from the main body of the image forming apparatus 1000. In FIG. 14B, a portion of the cable 555 which is in contact with an edge (a wall portion 1060 or 1061) of the hole 1056*a* is indicated by a dotted line 3100. Further, in FIG. 14B, a portion of the cable 555 which is in contact with the regulation portion 1062 is indicated by a dotted line 3101. In FIG. 14B, a length of the cable 555 from a portion where the cable 555 extending downward from the connector 504 is folded toward the front side of the main body of the image forming apparatus 1000 to a portion where the cable 555 is in contact with the edge (wall portion 1060) of the hole 1056*a* is indicated by an arrow-a1. In FIG. 14B, a length of the cable 555 from a portion where the cable 555 is in contact with the wall portion 1060 to a portion where the cable 555 is nipped by the regulation portion 1062 is indicated by an arrow-a2. In FIG. 14B, a length of the cable 555 from a portion where the cable 555 is connected to the connector 504 to a portion where the cable 555 extending downward from the connector 504 is folded toward the front side of the main body of the image forming apparatus 1000 is indicated by an arrow-b. In other words, a sum of the arrow-a1 and the arrow-a2 is expressed as an arrow-a, so that a sum of a length of a portion of the cable 555 indicated by the arrow-a and a length indicated by the arrow-b is a minimum length of the cable 555 from the regulation portion 1062 to the connector 504.

Figure 14C:
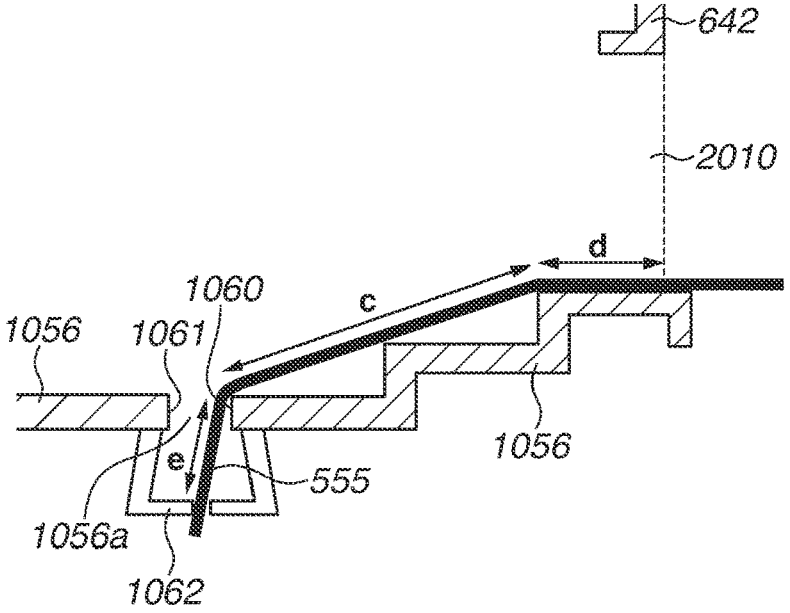

In FIG. 14C, the optical print head 105 is extracted from the main body of the image forming apparatus 1000, so that the cable 555 is folded toward the front side of the main body of the image forming apparatus 1000 with the first wall portion 1060 of the hole 1056*a* functioning as a fulcrum point. In this state, the cable 555 is stretched without warping. Herein, as illustrated in FIG. 14C, a sum of a length-c, a length-d, and a length-e as the length of the cable 555 from the hole 1056*a* to the opening 2010 is defined as a distance (shortest distance) between the hole 1056*a* and the opening 2010. Even in a case where a face on the upper side of the second supporting member 1056 has a step-like shape as illustrated in the example in FIG. 14C, the shortest distance can be acquired if the cable 555 is pulled toward the front side by bringing a portion connected to the connector 504 into contact with the edge of the lower end of the opening 2010. In other words, in a state where the cable 555 is nipped by the regulation portion 1062, the cable 555 is pulled toward the front side from the rear side, further on the front side than the opening 2010, and a distance between the regulation portion 1062 and the opening 2010 when there is no warp of the cable 555, is regarded as the shortest distance. A length of the cable 555 from the regulation portion 1062 to the portion connected to the connector 504 is longer than the above-described shortest distance.

In other words, a portion of the cable 555 extending from the regulation portion 1062 to the connector 504 in a state where the cable 555 is connected to the connector 504 has a length which positions the connector 504 further on the front side than the opening 2010, when the optical print head 105 is moved to the extraction position with the cable 555 connected to the connector 504.

With this configuration, the engineer can extract the first supporting member 526 to the extraction position where at least a part of the connector 504 is positioned further on the front side of the main body of the image forming apparatus 1000 than the opening 2010 of the front-side plate 642. The engineer moves the first supporting member 526 to the extraction position and detaches the cable 555 from the connector 504 positioned further on the front side than the opening 2010. Thereafter, the engineer further extracts the optical print head 105 toward the front side of the main body of the image forming apparatus 1000 and performs the maintenance work of the optical print head 105.

Figure 15:
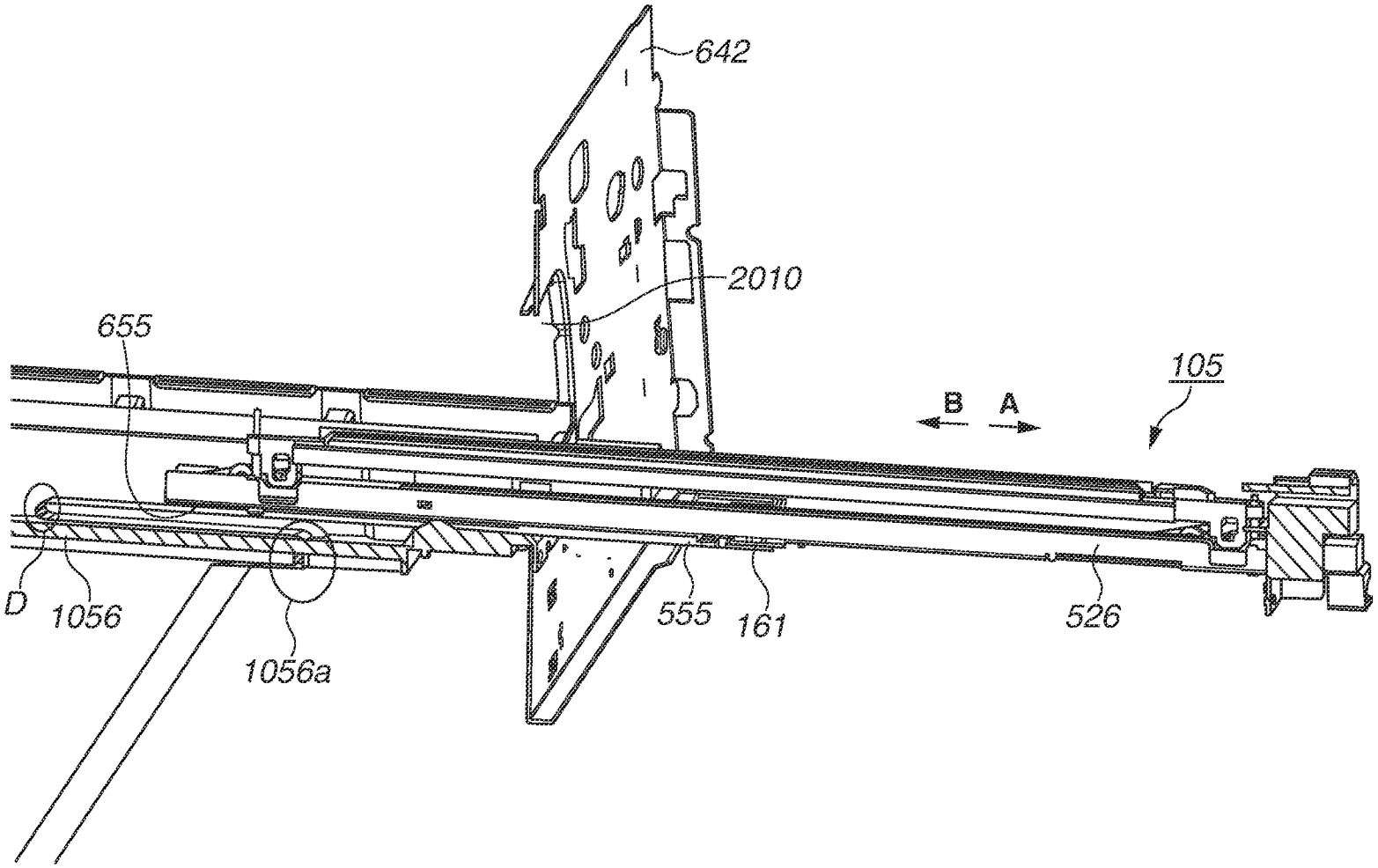
FIG. 15 is a diagram illustrating a first supporting member according to a second exemplary embodiment.

Hereinafter, a second exemplary embodiment will be described. FIG. 15 is a diagram illustrating a first supporting member 526 of the present exemplary embodiment. FIG. 15 illustrates a state where the first supporting member 526 is positioned at the extraction position. As illustrated in FIG. 15, the first supporting member 526 of the present exemplary embodiment does not include a member corresponding to the cable guide member 556 described in the first exemplary embodiment. The cable 555 coming out from the opening 161 formed on the first supporting member 526 in the lower vertical direction is folded toward the rear side of the main body of the image forming apparatus 1000. The cable 555 that extends from the opening 161 formed on the first supporting member 526 to the rear side of the main body of the image forming apparatus 1000 is folded further on the rear side than the hole 1056*a* formed on the second supporting member 1056, and forms a curved portion D. In other words, the hole 1056*a* is formed on the second supporting member 1056 further on the downstream side than the curved portion D in a direction in which the first supporting member 526 is extracted. The cable 555 that is folded and forms the curved portion D passes through the hole 1056*a* formed on the second supporting member 1056, and extends further on the lower side than the second supporting member 1056 in the vertical direction. Similar to the first exemplary embodiment, the regulation portion 1062 is arranged on the second supporting member 1056 at a position just beneath the hole 1056*a*. In other words, as with the case of the hole 1056*a*, the regulation portion 1062 is also arranged on the apparatus main body further on the downstream side than the curved portion D in a direction in which the first supporting member 526 is extracted.

Herein, the cable 555 according to the present exemplary embodiment is a flexible flat cable. The flexible flat cable is configured of a plurality of flux lines (electric wires) which is arranged in parallel at a regular interval and sandwiched between two insulation thin films. In consideration of resistance to abrasion, a polyethylene terephthalate (PET) material that is relatively excellent in mechanical strength is used for the insulation film. Therefore, the flexible flat cable in the present exemplary embodiment has a certain degree of strength, and a shape thereof is retained as a memory to some degree for a certain period of time if the flexible flat cable is warped as illustrated in the curved portion D.

Further, a portion illustrated as the curved portion D of the cable 555 is positioned between the upper side of the guide unit 1059 of the second supporting member 1056 and the bottom face portion 665 of the first supporting member 526. Therefore, the upper side of the cable 555 is in contact with the bottom face portion 665 of the first supporting member 526 and the lower side thereof is in contact with the upper side of the second supporting member 1056 in the vertical direction. The shape of the curved portion D of the cable 555 is maintained because the first supporting member 526 is reciprocally moved between the mounting position and the extraction position in such a state.

In the above-described exemplary embodiments, although four image forming units or optical print heads are used, the number of units to be used is not limited thereto, and may be appropriately determined as necessary.

Further, in the above-described exemplary embodiments, while a printer has been taken as an example of the image forming apparatus, the present disclosure is not limited thereto. For example, the present disclosure may be applicable to another image forming apparatus such as a copying machine, a facsimile apparatus, or a multifunction peripheral in which functions of the copying machine and the facsimile apparatus are combined with each other. Similar effects can be acquired by applying the present disclosure to the above-described image forming apparatuses.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-132661, filed Jul. 12, 2018, which is hereby incorporated by reference herein in its entirety.

What is claimed is:

1. An image forming apparatus comprising:

a photosensitive drum configured to rotate relative to an apparatus main body;

a print head configured to expose the photosensitive drum to light according to a driving signal from a main body substrate fixed to the apparatus main body;

a first supporting unit configured to support the print head and move to a mounting position at which the first supporting unit is mounted on the apparatus main body and an extraction position at which the first supporting unit is extracted from the apparatus main body together with the print head by sliding in a rotation axis line direction of the photosensitive drum;

a cable for connecting the main body substrate and the print head and configured to supply, to the print head from the main body substrate, a driving signal for driving the print head;

a second supporting unit having a holding portion for holding a part of the cable and regulating a movement of the part of the cable in a sliding direction, wherein the second supporting unit is fixed to the apparatus main body to support the first supporting member; and an abutting portion arranged on the first supporting unit further on a downstream side than a position at which the cable is connected to the print head, in a direction in which the first supporting unit moves from the extraction position to the mounting position, wherein, in a case where the print head moves to the mounting position from the extraction position in a state where the cable and the print head are connected to each other, the abutting portion abuts on the cable in one area between a portion held by the holding unit and a portion connected to the print head and moves the one area in a direction in which the first supporting unit moves to the mounting position from the extraction position to form in the one area a curved area that is warped and curved toward the mounting position from the extraction position.

2. The image forming apparatus according to claim 1, wherein the cable is a flexible flat cable.

3. The image forming apparatus according to claim 1, wherein the abutting portion is arranged on the first supporting unit such that the abutting portion is positioned further on a downstream side than the holding portion in a direction in which the first supporting unit moves to the mounting position from the extraction position in a case where the first supporting unit is positioned at the mounting position.

4. The image forming apparatus according to claim 1, wherein the holding portion nips and holds a part of the cable in a vertical direction or in a sliding direction to regulate a movement of the part of the cable in the sliding direction.

5. The image forming apparatus according to claim 1, wherein the print head includes a connector to which the cable is connected and a plurality of light emitting elements for emitting light to which the photosensitive drum is exposed, and wherein an opening through which the cable for connecting the main body substrate and the connector passes is formed on the first supporting unit at a position facing the connector.

6. The image forming apparatus according to claim 5, wherein the opening formed on the first supporting unit is a through-hole formed on a face on a lower side in a vertical direction of the first supporting unit, and wherein the abutting portion abuts on the cable upward in the vertical direction to support a part of the cable.

7. The image forming apparatus according to claim 1, further comprising:

a front-side plate arranged on a front side of the apparatus main body; and a rear-side plate arranged on a rear side of the apparatus main body, wherein one end of the second supporting unit in the rotation axis line direction is fixed to the front-side plate, whereas another end of the second supporting unit in the rotation axis line direction is fixed to the rear-side plate, and wherein an opening through which the first supporting unit moving between the mounting position and the extraction position passes is formed on the front-side plate.

8. The image forming apparatus according to claim 7, wherein, on a bottom face portion of the first supporting unit positioned on a side opposite where the print head is arranged, a first wall portion projected from one edge of the bottom face portion in a direction perpendicular to the rotation axis line direction, toward a side opposite to where the print head is arranged, and a second wall portion projected from another edge of the bottom face portion in the perpendicular direction, toward a side opposite to where the print head is arranged, are formed, and wherein one end of the abutting portion is arranged on the first wall portion whereas another end of the abutting portion is arranged on the second wall portion so as to connect the first wall portion and the second wall portion, and the cable is wired on a portion between the first wall portion and the second wall portion, and between the abutting portion and the bottom face portion.

9. The image forming apparatus according to claim 7, wherein, on a bottom face portion of the first supporting unit positioned on a side opposite to a side on which the print head is arranged, a first wall portion projected from one edge of the bottom face portion in a direction perpendicular to the rotation axis line direction toward a side opposite to where the print head is arranged, and a second wall portion projected from another edge of the bottom face portion in the perpendicular direction toward a side opposite to where the print head is arranged, are formed, and wherein the abutting portion is formed on the first wall portion or the second wall portion to be arranged between the first wall portion and the second wall portion, and the cable is wired on a portion between the first wall portion and the second wall portion, and between the abutting portion and the bottom face portion.

10. The image forming apparatus according to claim 9, wherein the first wall portion and the second wall portion are projected from the bottom face portion much more than the abutting portion, wherein, when the first wall portion and the second wall portion abut on an edge on a lower side in a vertical direction of the opening formed on the front-side face in a vertically lower direction, a gap is formed between the abutting portion and the edge on the lower side in the vertical direction of the opening formed on the front-side plate, and wherein, when the first supporting unit is positioned at the mounting position, the cable passes through a space further on the lower side in the vertical direction than the abutting portion and extends toward the holding portion.

11. The image forming apparatus according to claim 9, wherein the first wall portion is arranged further on one side than the opening formed on the first supporting unit in the perpendicular direction, wherein the second wall portion is arranged further on another side than the opening formed on the first supporting unit in the perpendicular direction, and wherein the first wall portion and the second wall portion are projected toward a side opposite to where the print head is arranged on the bottom face portion, much more than the cable extending toward the abutting portion from the opening formed on the first supporting unit.

12. The image forming apparatus according to claim 9, wherein inclined faces are each formed on an end portion on a downstream side of the first wall portion in a direction toward the mounting position from the extraction position, and an end portion on a downstream side of the second wall portion in the direction toward the mounting position from the extraction position, and the inclined faces are further inclined toward the first supporting unit on the downstream side in the direction toward the mounting position from the extraction position.

13. The image forming apparatus according to claim 12, wherein each of the inclined faces has an inclination angle of 10-degree or more and 40-degree or less relative to the rotation axis line direction of the photosensitive drum.

14. The image forming apparatus according to claim 9, wherein a length of the cable from the holding portion to the connector provided in the print head when the first supporting unit is positioned at the mounting position, is longer than a distance between the opening formed on the front-side plate and the connector when the first supporting unit is positioned at the mounting position.

15. The image forming apparatus according to claim 9, wherein a length of the cable from the holding portion to the connector provided in the print head is longer than a length of the cable from the holding portion to the opening formed on the front-side plate in a case where the holding portion and the opening are connected by the cable without warping the cable.

* * * * *